US008857015B2

(12) United States Patent
Hufen et al.

(10) Patent No.: US 8,857,015 B2
(45) Date of Patent: Oct. 14, 2014

(54) CARRIAGE AND SUSPENSION SYSTEM UTILIZING CARRIAGES

(75) Inventors: Michael Hufen, Wuppertal (DE); Axel Richstein, Hagen (DE); Andreas Finke, Gevelsberg (DE)

(73) Assignee: Dorma GmbH + Co. KG, Ennepetal (DE)

( * ) Notice: Subject to any disclaimer, the term of this patent is extended or adjusted under 35 U.S.C. 154(b) by 1275 days.

(21) Appl. No.: 12/673,736

(22) PCT Filed: Jul. 29, 2008

(86) PCT No.: PCT/EP2008/006264

§ 371 (c)(1),
(2), (4) Date: Feb. 16, 2010

(87) PCT Pub. No.: WO2009/021627

PCT Pub. Date: Feb. 19, 2009

(65) Prior Publication Data

US 2010/0139037 A1 Jun. 10, 2010

(30) Foreign Application Priority Data

Aug. 16, 2007 (DE) ..... 10 2007 038 846

(51) Int. Cl.
*E05D 15/00* (2006.01)
*E05D 15/06* (2006.01)
*E05F 15/18* (2006.01)

(52) U.S. Cl.
CPC ..... *E05D 15/063* (2013.01); *E05Y 2800/46* (2013.01); *E05Y 2201/688* (2013.01); *E05Y 2201/614* (2013.01); *E05Y 2600/53* (2013.01); *E05Y 2201/684* (2013.01); *E05D 2015/0695* (2013.01); *E05D 15/0652* (2013.01); *E05F 15/18* (2013.01)
USPC ..... 16/91; 16/96 R; 16/97; 160/201; 49/358; 49/360

(58) Field of Classification Search
USPC .... 16/87 R, 87.4 R, 91, 94 R, 95 R, 96 R, 97, 16/102, 106–107, 88; 160/345, 201; 49/358, 360
See application file for complete search history.

(56) References Cited

U.S. PATENT DOCUMENTS 5,134,324 A * 7/1992 Sakagami et al. ..... 310/12.04
5,852,897 A * 12/1998 Sukale ..... 49/358

(Continued)

FOREIGN PATENT DOCUMENTS

DE 604 171 10/1934
DE 673 196 3/1939

(Continued)

*Primary Examiner* — William Miller
(74) *Attorney, Agent, or Firm* — Cozen O'Connor

(57) ABSTRACT

A carriage includes body, at which at least one first roller is freely rotatably mounted, as well as a carriage suspension member with an upper terminal section is supported at or in the body and, with regard to the body, is pivotable about at least one axis of rotation extending parallel to the longitudinal extension of the carriage. A lower terminal section, the carriage suspension member is configured to extend in a downward direction towards a panel to be moved. The lower terminal section is adapted to suspend the panel to be moved therefrom. An axis of rotation of the at least one first roller extends transversely to the downward direction and transversely to a tangent of the travel path of the at least one panel to be moved in an area of the at least one first roller.

36 Claims, 14 Drawing Sheets

(56) References Cited

U.S. PATENT DOCUMENTS

| | | | | |
|---|---|---|---|---|
| 6,449,905 | B2 * | 9/2002 | Maki | 49/360 |
| 7,578,096 | B2 * | 8/2009 | Haab et al. | 49/409 |
| 7,592,720 | B2 * | 9/2009 | Busch | 310/12.24 |
| 8,474,185 | B2 * | 7/2013 | Busch | 49/358 |
| 2005/0172563 | A1 * | 8/2005 | Komoda | 49/358 |
| 2008/0100152 | A1 * | 5/2008 | Busch | 310/14 |
| 2009/0045760 | A1 * | 2/2009 | Busch | 318/135 |
| 2010/0139172 | A1 * | 6/2010 | Busch | 49/360 |

FOREIGN PATENT DOCUMENTS

| | | | |
|---|---|---|---|
| DE | 3602440 | A1 * | 7/1987 |
| DE | 4002487 | A1 * | 8/1991 |
| EP | 1013865 | A2 * | 6/2000 |
| EP | 1403459 | A2 * | 3/2004 |
| EP | 1681425 | A2 * | 7/2006 |
| GB | 1405931 | A * | 9/1975 |

* cited by examiner

CARRIAGE AND SUSPENSION SYSTEM UTILIZING CARRIAGES

PRIORITY CLAIM

This is a U.S. national stage of application No. PCT/EP2008/006264, filed on Jul. 29, 2008 which claims priority to the German Application No.: 10 2007 038 846.4, filed: Aug. 16, 2007; the content of both incorporated herein by reference.

BACKGROUND OF THE INVENTION

1. Field of the Invention

The invention relates to a carriage for the suspension of a panel to be suspended and to be moved along a travel path, as well as to a suspension system utilizing such carriages.

2. Prior Art

Suspension systems utilizing carriages, in particular for sliding door leaves, are well known. Such carriages usually have rollers which run on respectively one guiding rail.

One problem with such suspension systems is the readjusting of the sliding door leaf with regard to the suspension device. Over the time, a guiding rail may sag for example, such that the sliding door leaf may start to drag on the floor. The sliding door leaf then needs to be realigned with regard to its height adjustment.

Another problem arises in that the carriages are stationarily connected to the sliding door leaf. This means they do not change their position with regard to the sliding door leaf. When installing a sliding door suspension with several guiding rails, on which rollers of the carriages run, it may occur that the carriages are not precisely guided in, respectively on the guiding rails. Already a very slight inclination of the carriage, seen horizontally in a direction transversely to a longitudinal extension of the guiding rails, leads to a transverse load on the suspension for the sliding door leaf in the carriage and possibly on the guiding rails as well.

In case of relatively heavy sliding door leaves, for example made from glass, this might lead to an excessive load, to an excessive rubbing of the rollers in the guiding rails and/or at the profile and possibly to an uneven and possibly excessive load on the guiding rails. There might be the risk that the guiding rails, respectively a carrying profile bend or warp in transverse direction, which might lead to an irregular and jerky movement of the sliding door leaf.

SUMMARY OF THE INVENTION

An object of the invention is to provide a carriage and a suspension system for panels to be moved along at least one travel path, in which the suspension thereof eliminates or at least reduces the aforementioned shortcomings.

An inventive carriage comprises a body, at which at least one first roller is freely rotatably disposed, and a first suspension member, which, with an upper terminal section, is supported at or in the body and, with regard to the body, is pivotally supported about at least one axis of rotation extending parallel with regard to a longitudinal extension of the carriage. The first suspension member, with a lower terminal section, extends in a vertically downward direction towards a panel to be moved along a travel path. By the pivotal support, respectively the rotational support of the first suspension member with regard to the carriage, respectively the body thereof, it is achieved that a possibly occurring transverse inclination of the carriage with regard to a movement plane, respectively rolling plane of the at least one roller, respectively of the entire carriage can be automatically compensated for. The lower terminal section is adapted, respectively serves to suspend the panel to be moved. An axis of rotation of the at least one first roller extends transversely to the above described downward direction and transversely to a tangent of the travel path of the at least one panel to be moved in an area of the at least one first roller. In the case of a circular travel path for example, the axis of rotation of the at least one first roller is thus formed by a radius line or diameter line of the circle, which line intersects an axial center of this roller.

The inventive carriage preferably has at least one second roller. Analogously to the above described first roller, an axis of rotation of the at least one second roller extends transversely to the above described downward direction as well as transversely to the tangent of the travel path of the panel to be moved, this time in an area of the at least one second roller. In addition, the axis of rotation of the at least one second roller, seen in the direction of action of the rollers, has a predetermined vertical distance to the axis of rotation of the first roller, in a plane of action, which is formed by a direction of action of the rollers and a direction of extension of the axes of rotation of the rollers. In an installed condition, the rollers are disposed at different heights with regard to the plane of action, such that the lower one of the rollers can roll on a lower guiding rail and the upper one of the rollers can roll on an upper guiding rail.

In addition, the inventive carriage may have at least one third roller. Analogously to the above described first roller, an axis of rotation of the at least one third roller extends transversely to the above described downward direction as well as transversely to the tangent of the travel path of the at least one panel to be moved, this time in an area of the at least one third roller. In addition, the axis of rotation of the third roller, seen in the plane of action in a direction of action of the rollers, is disposed to be aligned with the axis of rotation of the first or of the second roller. The aligned disposed pair of rollers is thus disposed at the same height with regard to the plane of action, such that it may either roll on one and the same guiding rail or on two guiding rails, which, with regard to the plane of action, have the same height position. Thereby an additional stabilizing of the carriage is achieved. In addition, the rollers and the guiding rails may respectively have a flat running surface.

When seen in the course direction, respectively the extension direction of the axes of rotation, the first and the third rollers are preferably disposed at a front side of the carriage. The second roller is disposed at a rear side, which is opposite the front side and facing away from it. The corresponding guiding rails are thus disposed to extend at opposite sides of the carriage, serving to stabilize of the carriage. In addition such guiding rails are simple to incorporate into a carrying profile.

Furthermore, when seen in the direction of action of the rollers, the body of the inventive carriage may have an arm projecting to the front and/or an arm projecting to the rear. When seen in a direction transverse to the plane of action, each arm has a smaller depth, respectively thickness or gauge than a central section of the body. If there is one arm, when seen in the direction of action, the arm is adjoined by the central section of the body. If there are two arms, the central section is configured between the arms. The body is formed by the arms and of the central section. Respectively at least one roller is mounted to respectively one free end of each one arm. The at least one second roller is preferably mounted to the central section of the body. The smaller material thickness of the arms results in a resilient support of the rollers mounted to the arms such that possible jerky movements or unevenness in the guiding rail or on the running surface of one or more rollers can be dampened. In addition, possible inclinations, of the panel to be moved, in the direction of the travel path can be compensated for within certain limits. The first suspension member is received and supported at or in the central section of the body.

In an inserted condition of the carriage, in which the carriage is fitted in or inserted into the guiding rails, a vertical distance between respective rollers is preferably smaller than in a non-inserted condition of the carriage. Thus, the rollers do not only serve as a support and a spring for the carriage between the guiding rails, but also as an additional brace. The stability of the carriage, with regard to the guiding rails, is thereby improved.

The inventive carriage is preferably configured such that the first suspension member, with the upper terminal section, is, pivotally supported about an arbitrary axis. It is thereby achieved that not only transverse inclinations, but also other inclinations of the carriage can be compensated for. The upper terminal section of the first suspension member is preferably configured in the shape of a sphere which may be configured flattened at least at an end, which is formed by means of the upper terminal section of the first suspension member. The spherical shape of the upper terminal section, at least in a lower section, is a simple possibility to achieve the pivotability about arbitrary axes. As an alternative, the sphere may be configured flattened at least at an end, which is formed by means of the upper terminal section of the first suspension member and faces away from the panel to be moved.

According to the invention, the upper terminal section of the first suspension member is freely rotatably received and supported in a recess of the body. The recess is configured complementary to an exterior contour of the upper terminal section of the first suspension member with which the first suspension member reaches contact in the recess. In the case of the spherical shape, the recess has a partially hollow spherical shape.

As an alternative, the upper terminal section of the first suspension member is freely rotatably received and supported in a hollow space of the body. The upper terminal section is completely surrounded by the body. The hollow space, at least in an area, on which, respectively in which the upper terminal section of the first suspension member reaches contact, is configured complementary to the exterior contour of the upper terminal section of the first suspension member. Thus, the upper terminal section does not necessarily contact an inner surface of the hollow space with its entire surface, a circumstance which reduces friction between the hollow space and the first suspension member and thus reduces possible increased wear.

The first suspension member is preferably resiliently supported at an end, which is formed by the upper terminal section and faces away from the panel to be moved. The spring suspension is preferably realized by a spring, which, in case of a support in the hollow space of the body, is supported at an upper interior wall of the hollow space of the body at an end facing away from the first suspension member. This is in particular made possible by the fact that, as already described above, the hollow space reaches a direct contact with the upper terminal section only in a seating area.

In case of a recess, the spring is supported by a support at an end facing away from the first suspension member. The support, which preferably consists of a retaining ring, is stationarily accommodated in the recess.

Furthermore, the body of the inventive carriage has preferably a through-opening, which, from a seating surface of the recess or of the hollow space with regard to the first suspension member, extends in a direction away from the first suspension member towards the panel to be moved, i.e. parallel to the above described vertically downward direction.

According to one embodiment of the invention, the first suspension member is preferably adapted for mounting a second suspension member. The second suspension member in turn can be attached to the proper panel to be moved. As an alternative, it may be integrally configured with the panel to be moved or, in case of a framed sliding door leaf, it may be integral with the frame element thereof. The first suspension member has preferably a bushing in a lower terminal section. The bushing is freely rotatably disposed on the lower terminal section and protrudes from the lower terminal section with a section of predetermined length. This section preferably has a female thread section. At its upper terminal section facing the first suspension member, the second suspension member has a male thread section, configured complementary to the female thread section. The first and the second suspension members are mounted to each other by screwing the bushing onto the second suspension member. The bushing, at least in a partial section, has a non-circular exterior contour, which has the shape of an external hexagon for example. It is thus possible to mount the suspension members to each other and to adjust them, even if the panel to be moved is attached at the second suspension member or is integrally configured with it. In case of an external hexagon, simply a wrench is required. As the non-circular exterior contour is accessible from the outside, a simple height readjustment of an already suspended panel to be moved is possible.

In case of free rotatability of the first suspension member, the bushing is preferably integrally configured with the lower terminal section of the first suspension member. This is advantageous in that no support needs to be provided between the first suspension member and the bushing, which support, depending on the weight of the panel to be moved, might be exposed to enormous loads. In this case, it is not the bushing, but the first suspension member itself that is screwed to the second suspension member.

As an alternative, it might be intended that the bushing is disposed with the female thread section at the second suspension member such that its section of predetermined length projects from the second suspension member in the direction towards the first suspension member, the above described male thread section being configured at the lower terminal section of the first suspension member. In this case, an additional section with a non-circular exterior contour is configured at the first suspension member between the male thread section and the upper terminal section, such that the first suspension member can be screwed to the second suspension member.

The body of the inventive carriage is preferably configured block-shaped and it is furthermore preferred is made from plastic material. It is thereby possible to manufacture the body in a particularly simple manner, for example by injection moulding or extrusion.

Advantageously respectively one reception in the shape of a bore or of a through-opening is configured in the body for each rotational axis of the at least one roller. In an inner space, the respective reception has preferably one projection, which, in a plane transverse to a longitudinal extension of the respective rotational axis reception, is configured to project from an inner surface of the reception into its inner space. The rotational axis of the respective roller has a recess, which is configured essentially complementary to the projection such that, when inserting the rotational axis into the reception, the projection of the respective rotational axis reaches engagement with the projection of the reception. This state of engagement achieves an arresting of the rotational axis in the reception at least such that the respective rotational axis is prevented from a movement in a direction parallel to its longitudinal extension, i.e. out of the body or further into the body. The projection and the recess can be formed such that the rotational axis is additionally prevented from rotating. This is for example possible, if opposite edges of the projection and the reception are executed to be flat.

An inventive suspension system has at least one first, for example upper guiding rail. In addition, it has at least one panel to be moved along a travel path. The at least one panel to be moved is stationarily mounted to second suspension members of at least two, above described carriages, or is integrally configured with them. The respective rollers of the carriages roll on the at least one first guiding rail.

In addition, the inventive suspension system may have at least one second guiding rail. In this case, the carriages preferably have respectively at least two rollers. One of the at least two rollers of the respective carriage rolls on the at least one first guiding rail and the respective other roller of the respective carriage rolls on the at least one second guiding rail. In this case, running surfaces of the at least one first and second guiding rails are configured to face each other.

According to the invention, the guiding rails are disposed in a carrying profile or are configured integrally with it. This offers the advantage of forming the carrying profile and guiding rails for example as an extruded profile, which allows for an inexpensive manufacturing.

It is furthermore preferred the inventive suspension system has a profile, in which the carriages are stationarily received. The profile is open at a side facing the at least one panel to be moved and extends essentially parallel to a travel direction of the panel to be moved. The profile serves for positioning the carriages with regard to each other. In case of the above described circular travel path, when seen in the above described downward direction, the profile thus preferably extends along a reference line of the travel path. In addition, the profile and the carriage together may form a module, which can be installed as one entire part.

Furthermore, the inventive suspension system may have an additional carriage. It likewise comprises a body, at which, analogously to the above described carriages, at least one roller is freely rotatably mounted, an axis of rotation of the at least one roller extending transversely to a longitudinal extension of the additional carriage and transversely to the above explained downward direction. This at least one additional carriage is likewise disposed in the profile preferably between the above described carriages, from which one and the same panel to be moved is suspended. The difference to the above described carriages is that this at least one additional carriage does not have a reception for a first suspension member. It serves exclusively to stabilize the profile. In particular with very wide doors, a relatively long profile is required, which may sag or warp in operation and, under certain circumstances, might start to drag, for example along a guiding rail. The additional carriage helps to avoid this problem in a simple way.

The inventive profile has through-openings for inserting, respectively pushing through the rotational axes of the rollers of the carriages. The through-openings are disposed to be aligned with the respective rotational axis reception of the corresponding carriage body, thus they extend in a direction parallel to a longitudinal extension of the rotational axes. During installation, the respective body is inserted, respectively pushed into the profile to the positions of the through-openings. The rotational axes, if needed with rollers mounted at one side, are then introduced from the outside through a respective through-opening of the profile, into the respective rotational axis reception. Overall, this results in a very simple installation process for the carriages.

As an alternative, the through-openings are configured at two opposite sidewall sections of the profile such that the rotational axes are pushed through these two openings. Thereby the rotational axis is supported by means of the through-openings. In addition, this circumstance allows for mounting two rollers at both sides of one and the same rotational axis.

According to one embodiment of the invention, the profile has a C-shaped cross-section. In addition, when seen in cross-section, at free ends of the legs, it might have respective projections, which are configured to extend towards each other. Thus, a reception space for the carriages has been created, which allows for easy insertion of the bodies of the carriages from a front side of the profile into the reception space.

Preferably, the profile is composed of several parts, which are adapted to be stationarily mounted to each other. It is thereby possible to manufacture shorter and thus standardized profile pieces, by means of which profiles can be simply assembled, which have different lengths and executions, respectively dispositions with regard to the above described through-openings. Preferably, at sides facing each other, the profiles parts have respectively one part of a clip connection, or of a latching connection.

It is furthermore preferred the inventive suspension system has a linear drive system, which is preferably formed by means of a linear motor. The linear motor has a stator and a rotor. The stator is formed by means of a row of coils, which, at a predetermined distance to a side of the profile facing away from the panel to be moved, is stationarily disposed and extends at least over a portion of a travel path of the at least one panel to be moved. The linear motor drive system allows for an enormously low-wear drive system. The profile is preferably made from a magnetizable material and can be used itself as a rotor of the linear motor. Costs for otherwise necessary magnets are thus saved. However, according to the invention, the rotor may be likewise formed solely by a row of magnets or in conjunction with the profile, as long as the rotor is made from magnetizable material.

As an alternative, the linear drive system may be likewise formed by means of a spindle drive or a flexible drive.

The panel to be moved may be for example a sliding door leaf, a curved sliding door leaf, a partitioning wall module or a folding door leaf.

BRIEF DESCRIPTION OF DRAWINGS

Further features and advantages of the invention will become apparent from the following description of preferred embodiments, in which.

DETAILED DESCRIPTION OF THE DRAWINGS

Figure 1:
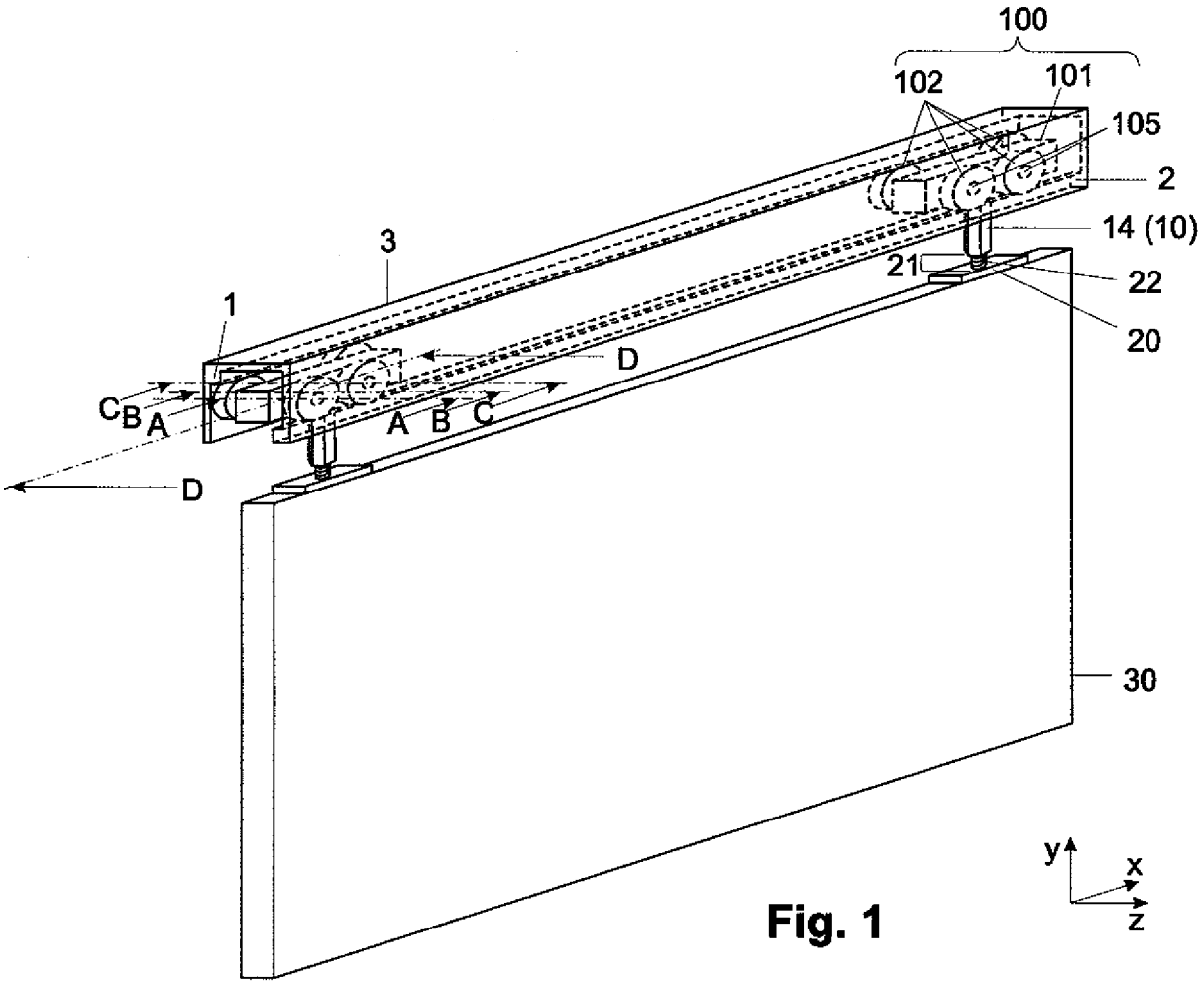
FIG. 1: is a perspective view of a suspension system according to an embodiment of the invention.

As illustrated in FIG. 1, a panel, by way of example configured as a sliding door leaf 30 to be moved along a straight travel path, is suspended at two carriages 100 according to an embodiment of the invention, forming a suspension system according to a first embodiment of the invention. For reasons of space, only the right portion of the suspension is provided with reference numerals. The suspension illustrated on the left side has the same components.

The sliding door leaf 30, at its upper border, is attached to sliding door leaf suspension members 20. At an upper terminal section 21, the suspension members 20 have respectively one male thread section 22 extending to the top, i.e. in y-direction in FIG. 1. The male thread sections 22 are screwed into a bushing 14 of a carriage suspension member 10. For this purpose, the bushings 14 have respectively one female thread, which is non-illustrated in FIG. 1.

At an upper end, each carriage suspension member 10 is received and pivotally supported in a body 101 of a respective carriage 100.

Rollers 102 are freely rotatably mounted to the body 101, preferably by means of rotational axes 105. In FIG. 1, four rollers 102 are mounted to each carriage 100, the respective rear rollers 102 being supported in an upper guiding rail 1 of a carrying profile 3 and the front rollers 102 in a lower guiding rail 2, likewise configured at the carrying profile 3.

Obviously, the guiding rails 1, 2 may be configured separate from the carrying profile 3 or the carrying profile 3 may be entirely omitted.

Even if respectively four rollers 102 are provided per carriage 100, more rollers 102 or also fewer rollers 102 may be provided.

Figure 2A:
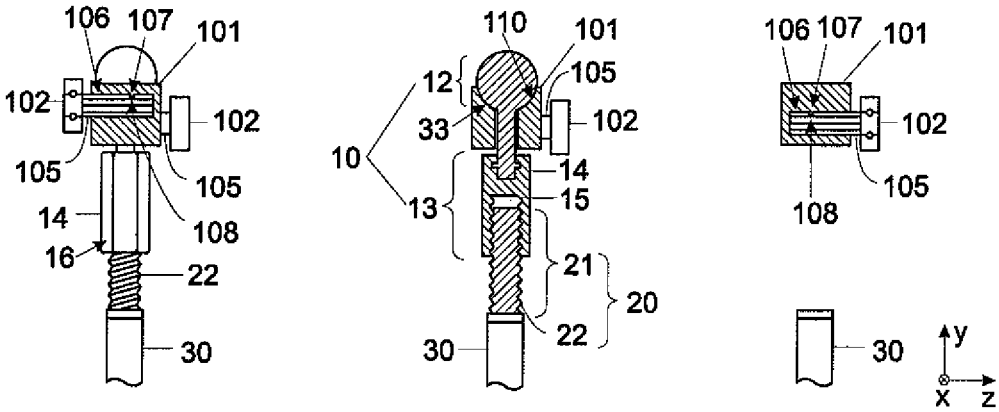
FIGS. 2A, 2B: are sectional views of a sliding door suspension along the lines A-A, B-B, or C-C in FIG. 1, according to different embodiments of the invention.

On the left side in FIG. 2A, a sectional view, along a line A-A in FIG. 1, of a sliding door suspension is illustrated according to a first embodiment of the invention. At the side of the body 101, rollers 102 are respectively freely rotatably supported on a rotational axis 105. The rotational axes 105 are preferably stationarily received in the body 101 of the respective carriage 100. Thus, with regard to the body 101, the rotational axes 105 represent spindle inserts. This means only the rollers 102 rotate.

Advantageously, the rollers 102 are supported by ball bearings on the rotational axes 105, as diagrammatically illustrated on the left side in FIG. 2A for the left roller 102. Obviously, they might be supported in plain bearings. For receiving the rotational axes 105, the body 101 has respectively one reception 106, which is preferably configured complementary to a corresponding exterior contour of the respective rotational axis 105. However, generally the reception may have a circular cross-section.

Preferably, each rotational axis 105 has an arresting recess 108 in the shape of a groove-shaped recess. At a corresponding location, the body has an arresting projection 107, which essentially is configured complementary to the arresting recess. The arresting projection 107 extends in a direction ±y, transversely to a plane of action x-z of the respective roller 102. The plane of action is defined by the direction of action ±x of the carriage 100, i.e. its direction of movement, and a horizontal direction ±z, transversely to the direction of action ±x of the carriage 100.

An interior diameter of the reception 106 is preferably equal to a maximum exterior dimension of the respective rotational axis 105. However, it might be slightly smaller than the exterior dimension such that, when being introduced into the respective reception 106, the respective rotational axis 105 will be clamped in it. In this case, the arresting projection 107 and the arresting recess 108 can be omitted.

In the center of FIG. 2A, a sectional view of the sliding door suspension is illustrated along a line B-B in FIG. 1. When seen in x-coordinate direction in FIG. 2A, an upper terminal section 12 of a carriage suspension member 10 has a circular cross-sectional area. Below the upper terminal section 12, the carriage suspension member 10 extends through a through-opening configured in the body 101 and, with a lower terminal section 13, projects from an underside of the body 101. A bushing 14 is freely rotatably disposed at the lower terminal section 13 of the suspension member 10 and essentially stationarily in ±y-coordinate direction. This means, the bushing 14 can either not move at all in ±y-coordinate direction or it can move only to a small extent, for example because of a play existing in ±y-coordinate direction between the bushing 14 and the lower terminal section 13.

The carriage suspension member 10, with a lower area of the upper terminal section 12, is received in a recess 110 of the body 101 and rotatably supported about at least one x-coordinate axis illustrated in FIG. 2A.

A sectional view of the sliding door suspension along a line C-C in FIG. 1 is illustrated on the right side in FIG. 2A, and shows a roller 102 disposed on the right side, which is configured analogously to the roller 102, illustrated in a section on the left side in FIG. 2, and received in the body 101.

Figure 2B:
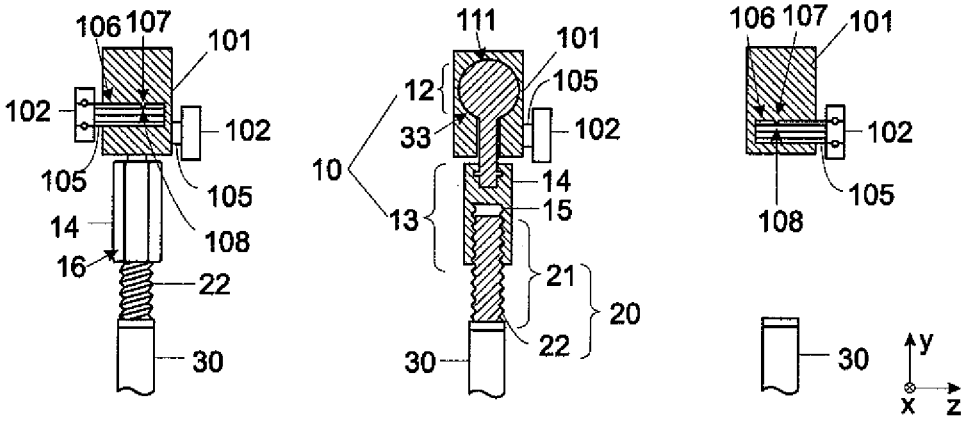

According to a second embodiment of the invention illustrated in FIG. 2B, the carriage suspension member 10 is received in the body 101, i.e. it is completely enclosed by the body. This circumstance has the advantage that no impurities can get between the carriage suspension member 10 and the body 101 and thus interfere with the rotatability of the carriage suspension member 10 or even prevent it from rotating. Thus, the body has a hollow space 111 instead of the reception 110 illustrated in FIG. 2B.

Figure 2C:
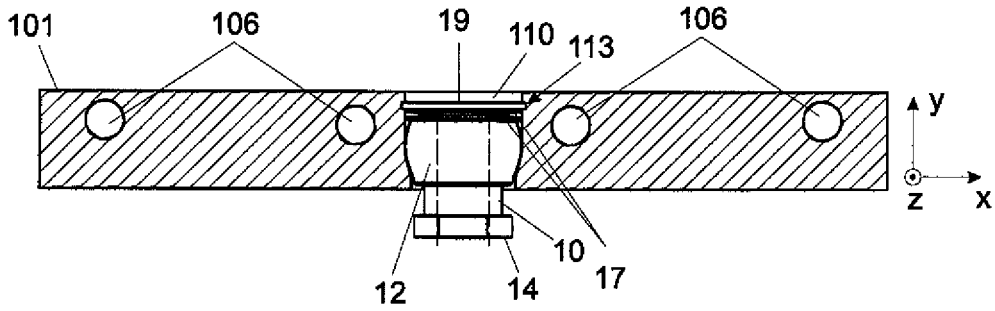
FIGS. 2C to 2E: are sectional views of bodies according to different embodiments of the invention of a respective carriage along a line D-D in FIG. 1.
Figure 2D:
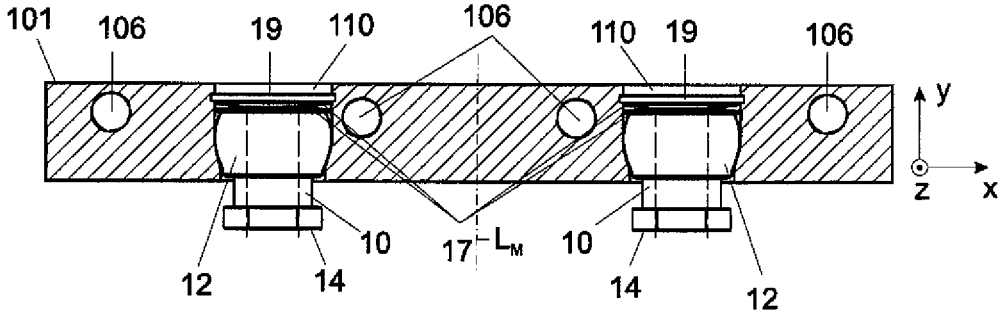
Figure 2E:
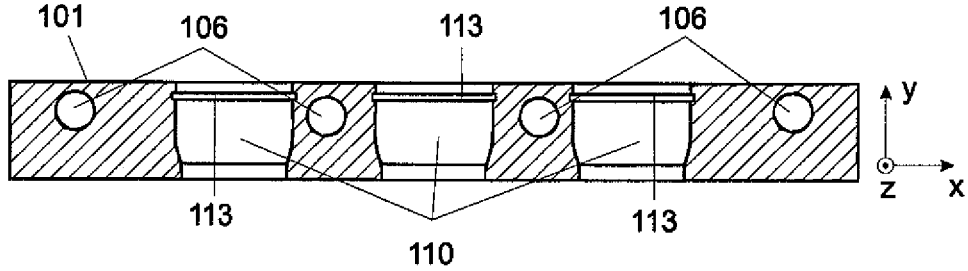

In FIGS. 2C to 2E, bodies 101 are illustrated according to different embodiments of the invention, respectively in a section along a line D-D in FIG. 1. For a better understanding, in FIGS. 2C and 2D, carriage suspension members 10 are shown as being inserted into the respective body 101, however not in a section. All embodiments have in common that they are configured similarly to the embodiment shown in FIG. 2A, carriage suspension members 10 are received in recesses 110 of the respective body 101.

According to an embodiment of the invention shown in FIG. 2C, the body 101 has four receptions 106 for non-illustrated roller rotational axes 105. They may be configured as through-bores, or as shown in FIG. 2A, not as a through-bore. In addition, the body 101 has a centrally disposed recess 110, when seen in z-coordinate direction. Preferably, the recess 110, when seen in y-coordinate direction, has a circular cross-section shape. Preferably a groove 113 is configured in the recess 110. The groove 113 extends essentially with the horizontal plane x-z of a carriage 100, to which the body 101 is associated. The surrounding groove 113 is configured at an inner surface of the recess 110. An abutment member, preferably in the shape of a retaining ring 19, is fitted into the groove 113. A surface of the abutment member, which faces the carriage suspension member 10 and is not concealed by the recess 110, serves as a contact or abutment surface for the carriage suspension member 10. In addition, as likewise shown in FIG. 2C, spring, here in the shape of disc springs 17, can be disposed between the carriage suspension member 10 and the abutment member. The resilient support of the carriage suspension member 10 will be explained in more detail in conjunction with FIGS. 2F to 2I. When seen in ±y-coordinate direction, the upper terminal section 12 of the carriage suspension member 10 preferably has a circular cross-section. In a direction, seen transversely to the y-coordinate direction, the upper terminal section 12 preferably has the shape of a circle, which is flattened at two opposite ends facing away from each other. A bushing 14, which preferably is integrally configured with the carriage suspension member 10 and, at least in a lower section, has a non-circular exterior contour, preferably in the shape of an external hexagon, is adjoining the upper terminal section 12 at the lower side.

A body 101, according to another embodiment of the invention illustrated in FIG. 2D, has two recesses 110, which, seen in ±z-coordinate direction, are disposed off-centre and are both preferably configured like the recess 110 illustrated in FIG. 2C. With regard to a centre line $L_M$ of the body 101, extending parallel to the y-coordinate axis when seen in ±z-coordinate direction, the recesses 110 are preferably disposed at respectively one side of the center line $L_M$ at identical distance to the latter.

A body 101, according to yet another embodiment of the invention illustrated in FIG. 2E, represents a combination of the embodiments shown in the FIGS. 2C and 2D. For reasons of simplicity, the respective carriage suspension members 10 have been omitted in FIG. 2E. This embodiment has the advantage of being suitable for both sliding door leaf suspension members, which respectively have only one suspension point, and sliding door leaf suspension members with several suspension points. In case even more receptions should be required, it is advantageous, for reasons of the stability of the body, to provide more than two rollers 102 per suspension side of a panel to be moved 30. As an alternative, the body 101 may be executed longer, have more than three recesses 110 or hollow spaces 111, preferably respectively at least one rotational axis reception 106 being configured for each directly adjacent pair of recesses 110, respectively hollow spaces 111.

Figure 2F:
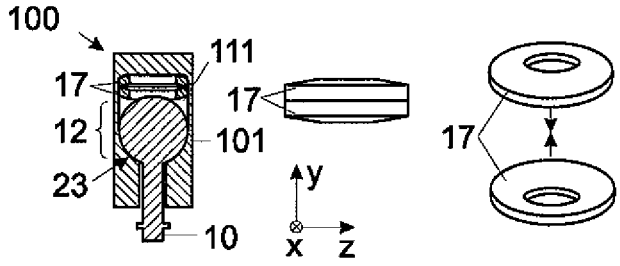
FIGS. 2F to 2L: are bodies of carriages in different configurations.

FIG. 2F shows a disposition of a carriage suspension member 10 in a body 101 of a carriage 100. A sectional view of this arrangement, along the line B-B in FIG. 1, is illustrated on the left side in FIG. 2F. Similarly to what is shown in FIGS. 2A to 2C, the carriage suspension member 10 is supported to the top in FIG. 2F at a spring element, respectively at spring means composed of disc springs 17. For illustration purposes, the disc springs 17 are additionally represented in a lateral view in the center and in a perspective view on the right side. Preferably, the spring element consists of two disc springs 17, which preferably bear against each other at a side, which respectively has a larger exterior diameter. The upper disc spring 17 is bearing against an interior wall of a hollow space 111 formed in the body 101, which wall faces the disc spring.

The disc springs 17 may be likewise disposed rotated by 180° about an axis parallel to the horizontal plane x-z, such that the disc springs 17 bear against each other at a side, which has the smaller exterior diameter. In addition, the spring element may be likewise composed of only one or of more than two disc springs 17. The two arrows on the right side in FIG. 2F represent the direction into which the disc springs 17 are to be moved towards each other with regard to an installation condition.

Figure 2G:
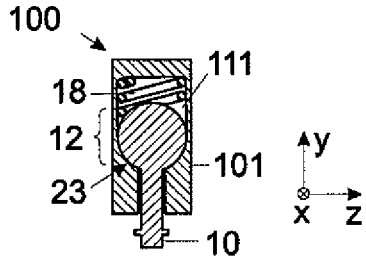

FIG. 2G shows another variant of a resilient support of the carriage suspension member 10, likewise as a sectional view along the line B-B in FIG. 1. Instead of disc springs 17, a helical spring 18 is utilized, which likewise bears against an upper interior wall of a hollow space 111 configured in the body 101.

Figure 2H:
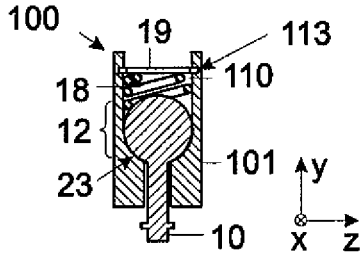

FIG. 2H shows the spring element of FIG. 2G, with the difference that the body 101 does not have a hollow space 111 but a recess 110. The spring element is supported to the top at an abutment, which is formed by a retaining ring 19. Analogously to the FIGS. 2A to 2C, the retaining ring 19 is received laterally in a groove 113.

Figure 2I:
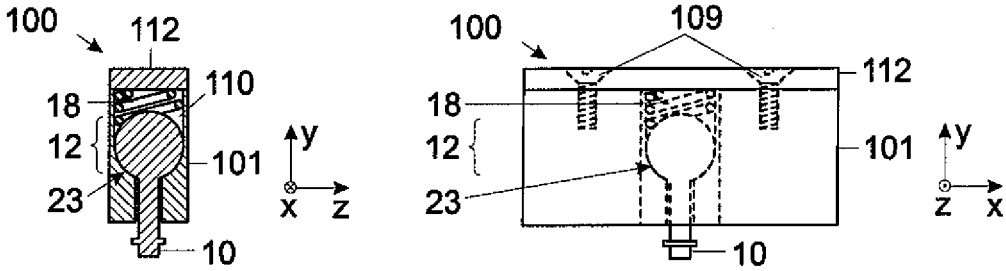

As an alternative, the spring element can be supported to the top at a cover member 112 of the carriage 100, such as shown in FIG. 2I. The cover member 112 is attached at the body 101 preferably by attachment screws 109. Preferably one area of an underside of the cover member 112, which gets in contact in the recess 110, forms an upper support surface for the spring element. As an alternative, a retaining ring according to FIG. 2H may be disposed in this area below the cover member.

Such an arrangement with a cover member 112 simplifies the installation of a carriage 100, because, after manufacturing the body 101, the spring element can be inserted into the carriage 100. Furthermore, with this execution it is possible to exchange a spring which has broken during operation, which helps to reduce repair costs.

The spring element is not limited to the described arrangements with disc springs and helical springs. Any spring element is conceivable, which can be incorporated into the body 101 of the carriage 100. The spring element may be formed by a hinge spring for example, the legs thereof bearing against the carriage suspension member 10, respectively at an inner side of a hollow space 111 or at a support surface.

On the one hand, the arrangement with the cover member 112 is readily applicable to the disc spring arrangement shown in FIG. 2F. On the other hand, it may be applied to the arrangement shown in FIG. 2B. This has the advantage that, once the body 101 has been manufactured, the carriage suspension member 10 can be inserted and exchanged if needed, which again helps to reduce repair costs.

Figure 2J:
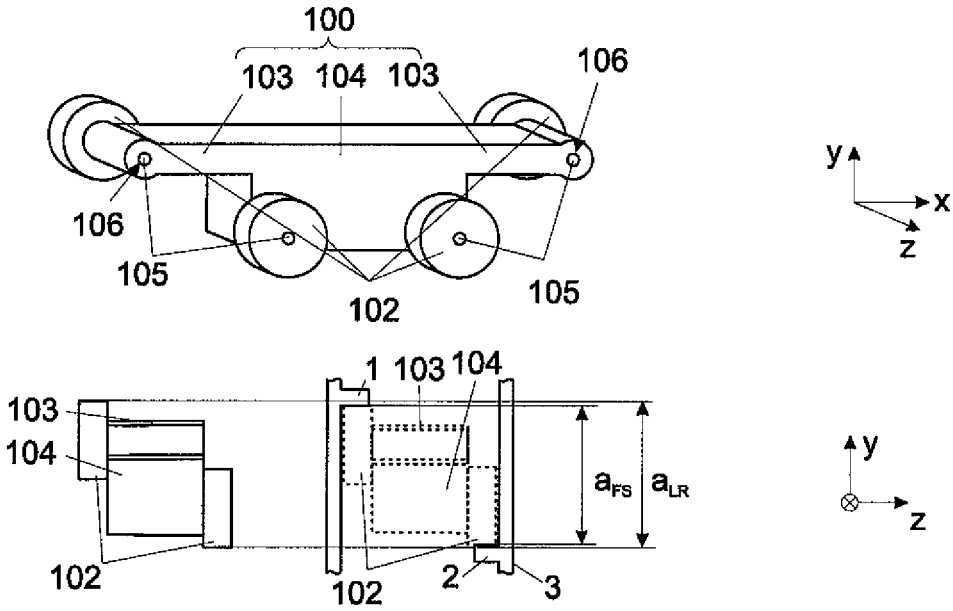

According to another embodiment of the invention shown in FIG. 2J, the body 101 has arms 103, when seen in z-coordinate direction in FIG. 2J, which are configured at the sides and have a smaller thickness than a central section 104 of the body 101. At a free end, each arm has preferably one reception 106 for a respective rotational axis 105 of a roller 102.

As shown in a lower part of FIG. 2J, the uppermost location of a respective upper roller 102 has a distance $a_{LR}$ to a lowest location of a lower roller 102 in a non-inserted condition, in which the carriage 100 is not inserted in the guiding rails 1, 2, which distance is preferably slightly larger than a distance $a_{FS}$ of running surfaces of the guiding rails 1, 2 to each other.

When inserting the carriage 100 into a carrying profile 3, illustrated on the bottom of FIG. 2J as a detail, having an upper guiding rail and a lower guiding rail 2, the rollers 102 are braced between the guiding rails 1, 2. The carriage 100 is illustrated as a dotted line. The upper rollers 102, mounted to the arms 103, are pressed or urged downwards and the free ends of the arms 103 are thereby bent downwards. This means, in an inserted condition, the following is valid: $a_{FS}=a_{LR}$. At least the arms 103 are made from an elastic material, for example an elastically deformable plastic material. As a non-illustrated sliding door leaf 30 is usually suspended from at least two carriages 100, it may be likewise intended that the body 101 has only one arm 103 and furthermore, only one roller 102 is mounted to the body 101. On account of the interaction of both carriages 100, if they are inserted into an upper guiding rail 1 and into a lower guiding rail 2, the resilient support of the rollers 102 is realized by the two arms 103 of both carriages 100.

Figure 2K:
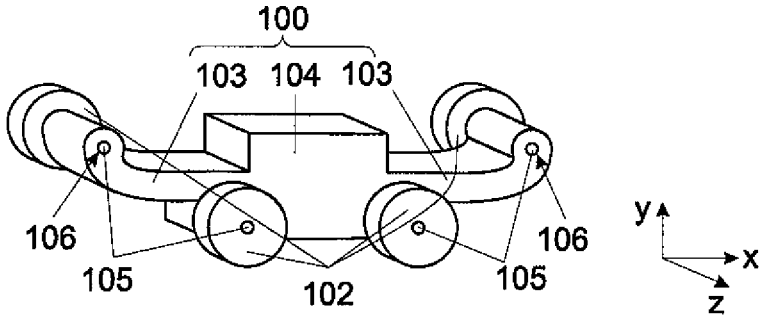

A body 101, according to another embodiment of the invention, is illustrated in FIG. 2K. In this case, the arms 103 are attached at the central section 104 of the body 101 below an upper border of the body 101, or they extend therefrom. A section of the central section 104, located above the arm attachment, seen in z-coordinate direction, has preferably a smaller width than a width of the central section 104 below this upper section. The upper section has minimum dimensions, which are required to reliably receive the carriage suspension member 10. Material savings for the body 101 are thereby possible at the said upper section.

The curved form of the arms 103 results in an advantageous transfer of forces from the exterior ends of the arms 103 into the central section of the body 101, thus the load-bearing capacity and stability of the arms 103 can be increased. In addition, the lower attached arms 103 offer a longer spring deflection of the free ends of the arms 103.

Figure 2L:
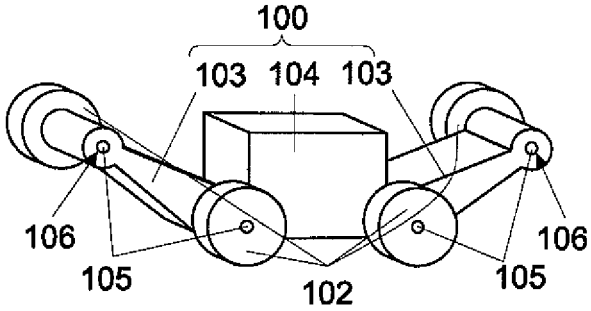

According to yet another embodiment of the invention shown in FIG. 2L, the arms 103 are attached, respectively mounted to the central section 104, likewise on the bottom. A lower section of preferably each arm 103 has simultaneously a reception 106 for a rotational axis 105 of a roller 102. Further material can be saved with this configuration.

Instead of or in addition to the arms 103, it may be provided to resiliently support the rotational axes 105. This may be realized for example like described in conjunction with the carriage suspension member 10 in the body 101. This means, the respective rotational axis reception 106 has a larger inner space than the exterior dimensions of the respective rotational axis 105. It is of advantage to have an oval shaped external bushing in cross-section, into which an internal bushing is fitted. The respective internal bushing has a through-opening for the reception of the respective rotational axis 105 and is resiliently supported in the external bushing. The external bushing (with the resiliently supported internal bushing) is fitted into the body. Thereupon, the rotational axis can be fitted into the internal bushing, resulting in a very simple installation.

Figure 3A:
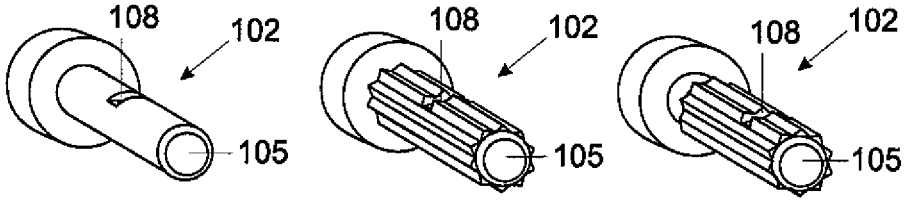
FIG. 3A: are rollers in different configurations.

Three rollers 102 are shown by way of example in FIG. 3A, which are provided with an above described arresting recess 108. In contrast to the embodiment illustrated on the left side in FIG. 3A, the roller 102, illustrated in the centre, has a serrated exterior contour in cross-section, by means of which the rotational axis 105, when being inserted into a non-illustrated reception 106 of the body 101, reaches positive engagement with the former, such that the rotational axis 105 can not rotate with regard to the body 101. For aesthetical reasons, as illustrated on the right side in FIG. 3A, it may be intended to configure the serrated exterior contour only in the area of the rotational axis 105, which will entirely disappear in the rotational axis reception 106. A section of the rotational axis 105, between this area and an area of the respective roller 102, is preferably configured with a circular cross-section.

The rotational axis 105 may be configured conically towards its free end, such that a cross-sectional area of the rotational axis 105 at the end, facing away from the roller 102, is smaller than a cross-sectional area for example in the vicinity of the roller 102. Introducing the rotational axis 105 into the body 101 is thus made easier. This is particularly favourable, if the arresting projections 107 and arresting recesses 108 are provided.

Figure 3B:
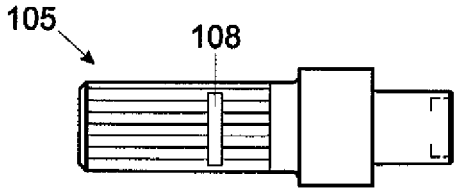
FIG. 3B: is a roller rotational axis according to an embodiment of the invention.

In FIG. 3B, a rotational axis 105 is shown according to another embodiment of the invention. It differs from the rotational axis 105, shown on the right side in FIG. 3A, in particular in that a section of the rotational axis 105, which is located between a first section, which, in the inserted condition, is received in a non-illustrated body 101, and a roller section, on which a non-illustrated roller 102 is freely rotatably disposed, has a larger exterior dimension than the first section and the roller section.

On the one hand, a depth abutment is thereby created with regard to an insertion into a body 101. This means, the shape of the rotational axis 105 determines a maximum depth up to which the rotational axis 105 can be pushed maximally into a body 101. On the other hand, an abutment for placing a roller 102 is formed at the same time.

Figure 4A:
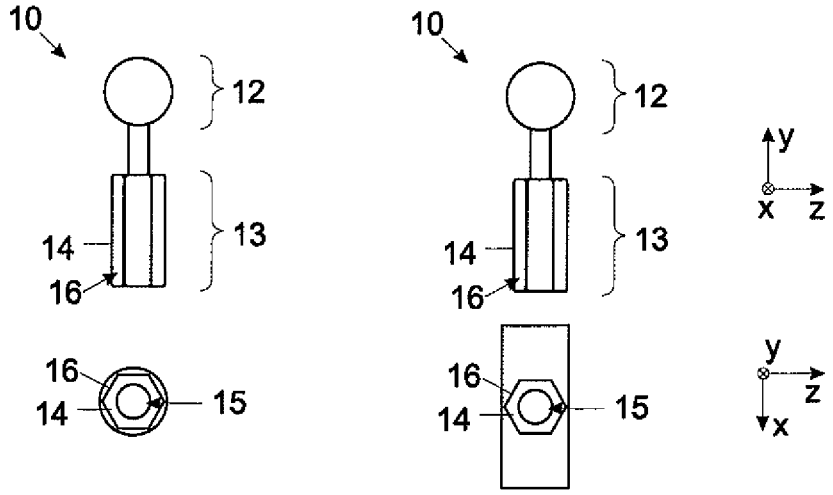
FIG. 4: shows roller suspension members in different configurations.

The embodiments of a carriage suspension member 10 shown in FIG. 4A mainly relate to the upper terminal section 12 thereof. As an example, all carriage suspension members 10, illustrated in FIG. 4, have respectively one bushing 14 with a female thread or a female thread section 15. Preferably, the bushing 14 has a non-circular exterior contour, and furthermore preferably the shape of an external hexagon section 16, as can be seen in particular on the bottom left in FIG. 4A. The non-circular exterior contour serves the purpose of being able to bring a tool, for example a wrench, in positive engagement with the exterior contour. Thereby, it is possible to rotate the bushing 14 in a very simple way by a usual tool. On account of the female thread section 15 of the bushing 14 being in an engagement condition with a male thread section 22, according to FIGS. 1 and 2, mounting a sliding door suspension member 20 and/or the height adjustment thereof with regard to the respective carriage 100, guided in at least one guiding rail 1, 2, can be accomplished even if a sliding door leaf 30 is already mounted to the sliding door suspension member 20.

However, the lower terminal section 13 can be configured such as already described above. In a first embodiment shown on the left side in FIG. 4A, the upper terminal section 12 is configured as a sphere and is pivotally or rotatably supported preferably about any axis parallel to the horizontal plane x-z.

According to an embodiment shown on the right side in FIG. 4A, the upper terminal section 12 is configured as a cylinder, located in the horizontal plane x-z, the longitudinal extension thereof extending parallel to the x-coordinate axis. Such a configured suspension member 10 is supported to be turned or rotated at least about the x-coordinate axis.

Figure 4B:
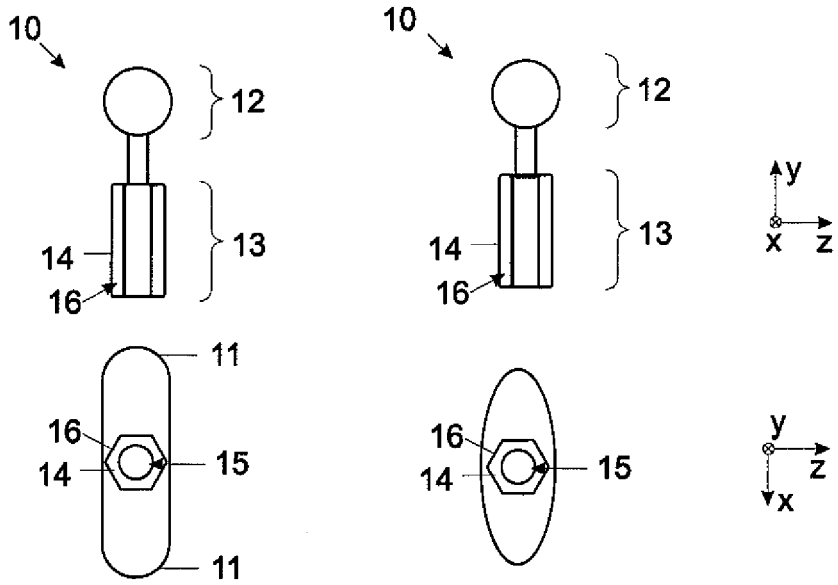

According to an embodiment shown on the left side in FIG. 4B, the frontal faces 11 of the cylinder-shaped configured upper terminal section 12 are not formed flat but convexes. Preferably, the frontal faces 11 have the shape of hemispheres.

In another embodiment shown on the right side in FIG. 4B, the upper terminal section 12 is configured ellipsoid. It is thereby possible to configure the reception 110, 111 such that the carriage suspension member 10 can be rotated about several axes in the horizontal plane x-z, however at different deflection degrees. The maximum degree of the respective deflection is determined by the shape of the curvature at least of a seating surface of the carriage suspension member 10 in a direction transversely to the respective axis of rotation and by the expenditure of forces when rotating the carriage suspension member 10.

If the curvature of the seating surface is circular, as for example shown at the top right side in FIG. 4B with regard to an axis of rotation x, on account of the seating surface there is no restriction as to the deflection, it can be limited only by the shape of the through-opening configured in the body. If the curvature of the seating surface has the shape of a flat side of an ellipse, such as it is the case for example on the right side in FIG. 4B with regard to an axis of rotation z, the ends of the ellipsoid seen horizontally, during the rotation thereof about the z-coordinate axis, move in ±x-coordinate direction to a certain extent. It is thereby possible to limit the maximum deflection degree of the carriage suspension member in ±x-coordinate direction by walls extending in ±y-coordinate direction, of a recess 110 or a hollow space 111, as well as by means of an opening width of a through-opening in the body 101. Furthermore, the seating surface of the carriage suspension member 10 is larger than in case of a circular shape. The friction between the carriage suspension member 10 and the body 101 is thereby larger, which increases the expenditure of forces for rotating the carriage suspension member 10 and thus makes rotating more difficult. This is advantageous insofar that, if, for example a person bumps against a sliding door leaf 30, it will result in pivoting of the latter only from a certain force onwards.

It is however not required to configure the upper terminal section 12 in an upper section with a semi-circular cross-section. According to embodiments, illustrated in FIG. 4C, the upper section can be configured flattened and preferably convex. The convex shape is for example advantageous, if the upper terminal section 12 is received in a recess 110, illustrated in the center of FIG. 2, and if there is only little space to the top, for example to an inner side of a carrying profile. In addition, with such a flattened shape, a deflection limitation can be likewise configured by an inner surface of the body 101 disposed above the carriage suspension member 10. In this case, one of the ends of the carriage suspension member 10, seen in the horizontal plane x-z, at a predetermined degree of rotation or of deflection of the carriage suspension member 10, abuts against the upper inner surface; any further rotating, respectively deflecting of the carriage suspension member 10 is not possible.

Figure 4C:
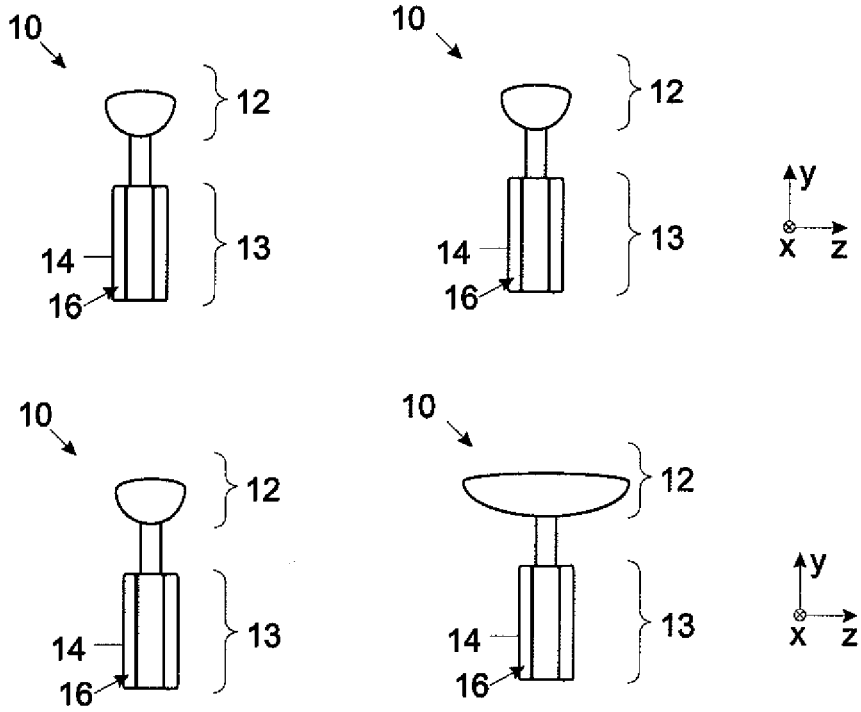
Figure 4D:
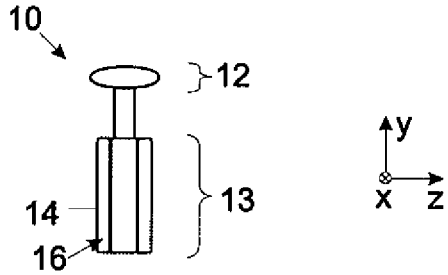
Figure 4E:
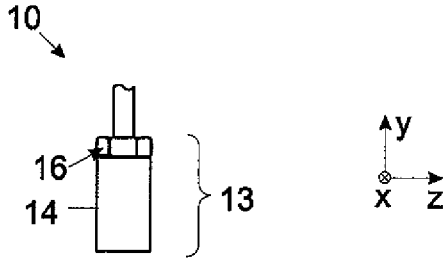

The seating surface of the upper terminal section 12, i.e. the surface, which rests on a corresponding surface of the body 101, may be flattened, such as illustrated in FIG. 4D. The upper and/or lower flattenings, illustrated in FIGS. 4C and 4D, are applicable to all upper terminal sections 102, illustrated in FIGS. 4A and 4B.

FIGS. 4A to 4D respectively show a bushing 14 configured with a continuous external hexagon section 16. According to an execution shown in FIG. 4E, the external hexagon section 16 is only configured preferably in an upper area of the bushing 14. This is in particular advantageous, if the associated carriage 100 is held in a non-illustrated carrying profile 3. It is thereby possible that the external hexagon section 16 is screened to the outside by the carrying profile 3, such that only the remaining section of the bushing 14 is visible. This remaining section may be configured according to aesthetical aspects. For example an offset wrench may be utilized for rotating the bushing 14. An advantageous shape is for example the circular cross-section indicated in FIG. 4E. Other examples are illustrated in FIG. 5B which will be explained later.

Figure 5A:
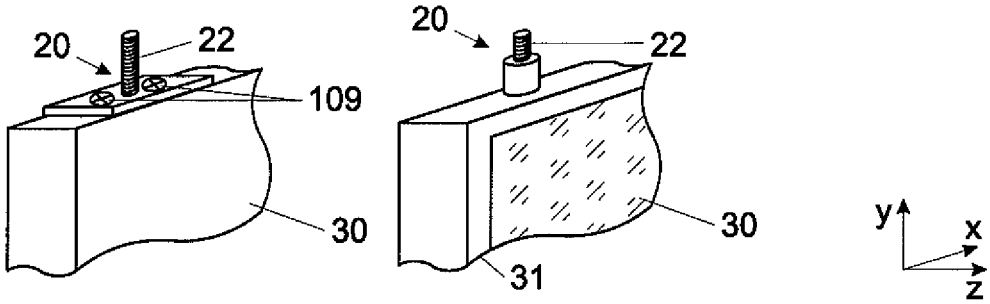
FIG. 5: are sliding door suspension members mounted to sliding door leaves in different configurations.
Figure 5B:
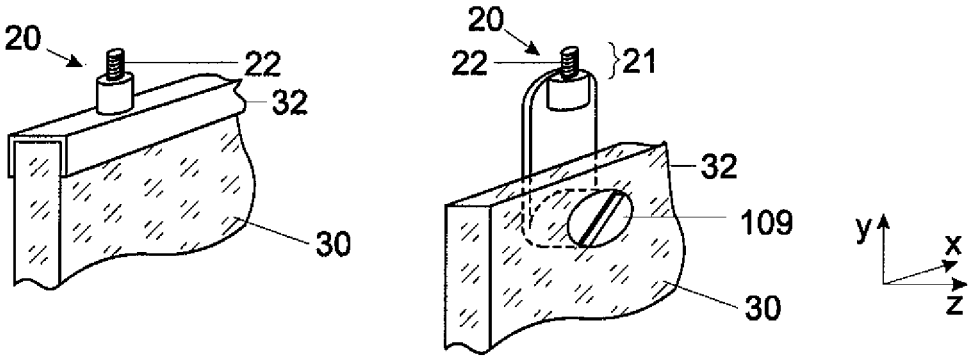

A sliding door suspension member 20, as illustrated on the left side in FIG. 5A, may be attached to a solid sliding door leaf 30 for example by attachment screws 109. As an alternative, it may be configured integrally with the sliding door leaf 30.

The same applies to a framed sliding door leaf 30. On the right side in FIG. 5A, a glass frame sliding door leaf 30 is illustrated by way of example, in the present case, the sliding door suspension member 20 being integrally configured with a frame 31. In a suspended condition of the glass frame sliding door leaf 30, preferably only the section of the sliding door suspension member 20 is visible, which is located below the male thread section 22.

But such a sliding door suspension member 20 is likewise applicable with a frameless glass sliding door leaf 30. As illustrated on the left side in FIG. 5B, an all-glass sliding door leaf 30 is held in a clamping part 32, which, in the illustrated case, is configured integrally with the sliding door suspension member 20.

As an alternative, a sliding door suspension member is conceivable, as illustrated on the right side in FIG. 5B. In this case, the sliding door suspension member 20 is configured such that a lower section of the suspension member 20, extending in z-direction, is disposed as passing from one side of the all-glass sliding door leaf 30 through the latter. At a side opposite the one side of the all-glass sliding door leaf 30, the suspension member 20 is fixed to the all-glass sliding door leaf 30 for example by means of a screw 109. An upwards directed male thread section 22 is configured at the upper terminal section 21 for mounting the sliding door suspension member 20 to a carriage suspension member 10.

Figure 6:
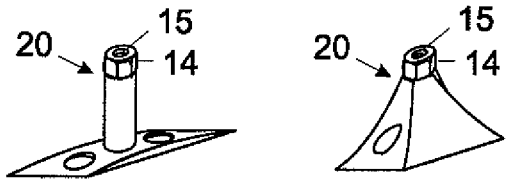
FIG. 6: are sliding door suspension members in different configurations.

The sliding door suspension member 20, except for the male thread section 22, may be designed according to aesthetical aspects. In FIG. 6, two variants of a sliding door suspension member 20 are illustrated, which are configured to be mounted to a non-illustrated sliding door leaf 30. In addition, in these variants, the bushing 14 is configured at, respectively mounted to the sliding door suspension member 20 instead of to the carriage suspension member 10. Even if non-illustrated, in this case, at the lower terminal section 13, the associated carriage suspension member 10 has a correspondingly configured male thread section 22 ending at a lower end of the lower terminal section 13.

Even if respectively one roller 102 is freely rotatably mounted only to one side of the rotational axis 105 in the here illustrated embodiments, obviously executions are possible, in which at least one rotational axis 105 projects from both ends of the body 101, a roller 102 being freely rotatably mounted to each end.

In addition, it may be intended that the rollers 102 have a predetermined play on the rotational axes 105 in a direction transversely to their direction of action ±x, ie. in ±z-coordinate direction in the Figures. Thus the rollers are additionally adapted to move in the direction transversely to their direction of action ±x and thus to compensate for possible deformations of a respective guiding rail 1, 2 or of a carrying profile 3. This play may be realized in that a respective rotational axis 105 has inner and exterior abutments. These abutments can be realized in that the rotational axis 105 has a circumferentially surrounding groove at a respective location, in which respectively one retaining ring is placed. This has the advantage that the rollers 102 can be exchanged even afterwards. As an alternative, at least the inner abutment is integrally configured with the rotational axis 105.

The play in the support is particularly advantageous, if the rollers 102, seen in the direction of action ±x, have a groove-like running surface for example, and the corresponding guiding rail(s) have a complementarily, preferably crowned configured running surface or vice versa. In this case, the rollers 102 themselves are not able to compensate for tolerances in ±z-coordinate direction in the Figures.

Furthermore, it is possible to dispose the rotational axis 105 freely rotatably in the body 101 instead of disposing it torque-proof with regard to the body 101. This may be realized in that a ball bearing supported bushing is fitted, pressed, or in any other way torque-proof disposed in the body 101 in a rotational axis reception 106. The respective rotational axis 105 is fitted in the bushing such that the rotational axis 105 can not move or only move with little play in the ±z-coordinate direction in the Figures. The respective rollers(s) 102 is (are) disposed torque-proof or again freely rotatably on the rotational axis 105.

Manufacturing the body 101, here preferably configured as one piece, is very simple. Preferably, at least the upper terminal section 12 of the carriage suspension member 10, at least in a reception area, in which it is to be received in a recess 110 or in a hollow space 111 of the body 101, is made from a material which, by a predetermined measure, expands more with heat than a material from which the body 101 is made at least in the corresponding reception area, formed by the recess 110 or the hollow space 111. Preferably, at least the upper terminal section 12 is made from metal in this area, and the body 101, in the corresponding area, is made from plastic material. When manufacturing the body 101, the upper terminal section 12 of the carriage suspension member 10 or, in case of a recess 110, a production piece, identically manufactured at least in the said reception area of the upper terminal section 12, is heated to a temperature according to a predetermined expansion, which piece can be used several times for manufacturing purposes. Preferably, the heated piece is inserted or pushed into an injection mouldand moulded-in the plastic material for the body 101. During the following cooling, the body 101 and the heated piece separate from each other such that the carriage suspension member 10 can be rotated in the body 101 or the manufacturing tool can be non-destructively removed from the body.

As an alternative, the body 102 can be shaped by extrusion around the carriage suspension member 10 or around the manufacturing tool.

The body 101 may be likewise composed of two halves, which are fixed to each other for example by attachment screws.

The here presented carriages 100 are in particular suitable for installations in which a linear drive is utilized for moving the panel(s) to be moved.

Preferably, the linear drive is formed by one or several linear motors. Usually a linear motor consists of a stator, which is stationarily mounted to a carrying profile for example, and of at least one rotor mounted to the respective panel to be moved. Typically the stator is formed by a row of coils, which are disposed next to each other. Typically, the row of coils extends along at least one portion of the travel path of the at least one panel to be moved 30. Winding wires are wound around the coils according to an n-phased connection diagram, in which: $n \in N$, $n \geq 1$. The rotor consists typically of either magnetizable material or of a row of permanent magnets. The rotor essentially extends parallel to a longitudinal extension of the stator.

Figure 7A:
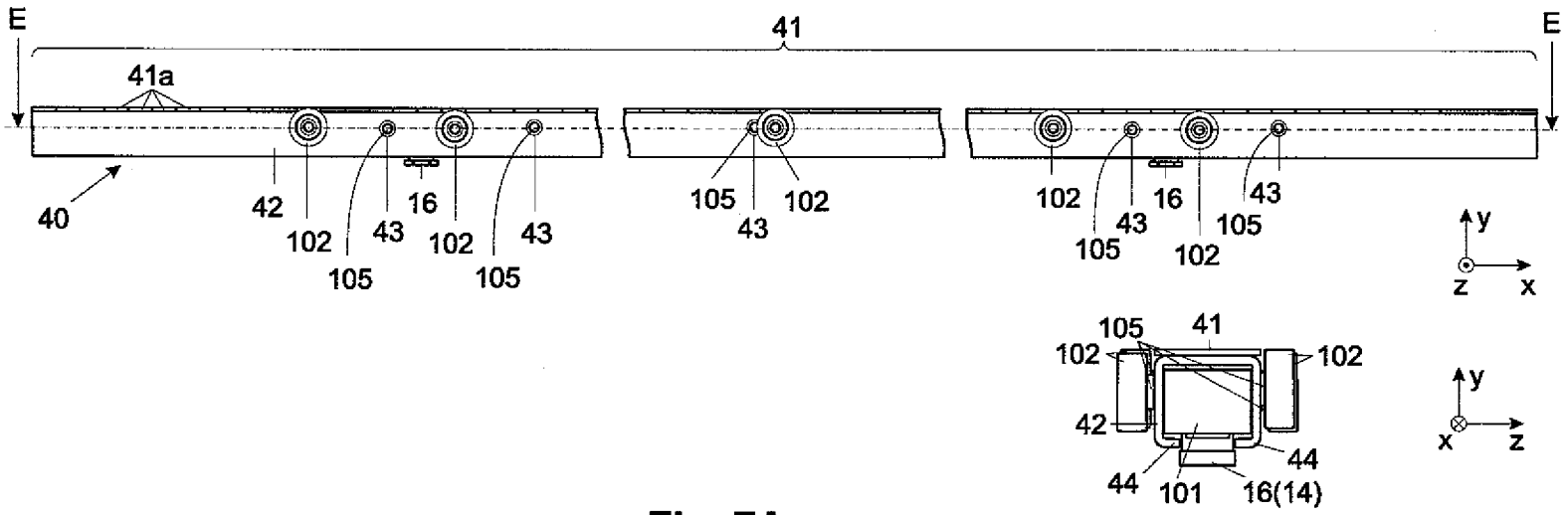
FIG. 7: are a suspension system according to another embodiment of the invention.
Figure 7B:
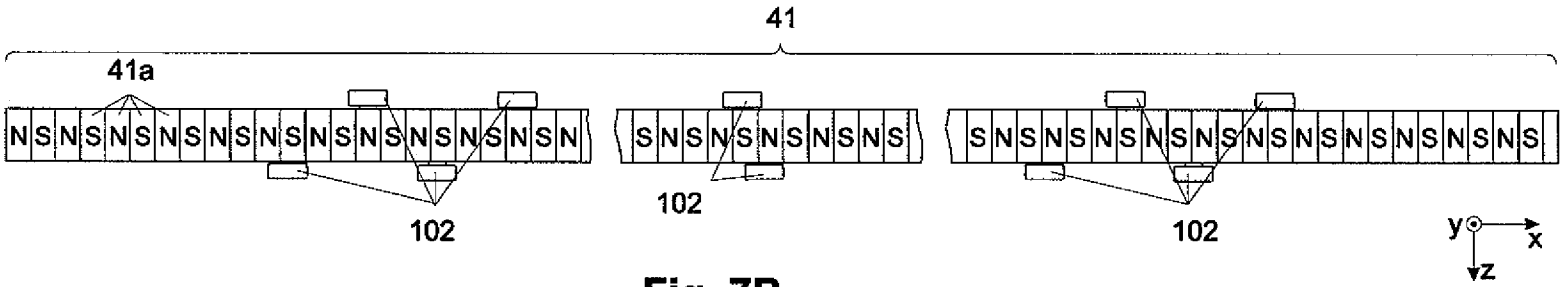
Figure 7C:
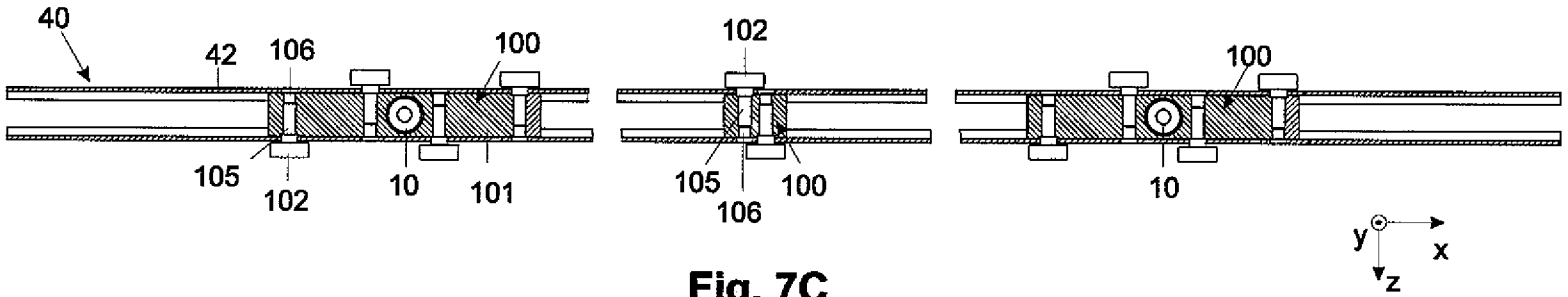

FIGS. 7A to 7C show a rotor 40, preferably configured as a module, of a linear motor, to which carriages 100 are mounted according to one of the above described embodiments. Preferably, the rotor 40 has a row 41 of permanent magnets 41*a*. According to the embodiment of the invention shown in FIG. 7A, the magnets 41*a* are attached or mounted to a profile 42 which is essentially C-shaped in cross-section. As an alternative, the rotor may be formed by means of magnets 41*a*, which are disposed on a surface of the respective body 101, facing a non-illustrated stator. Mounting can be done by gluing, for example. As an alternative, the magnets 41*a* are all together combined to a module. The module may be formed for example in that individual magnets 41*a* are disposed in one row and moulded by means of a casting compound. In addition, the casting compound may be used to mount or to attach the row of magnets 41 on the profile 42.

If the C-shaped profile 42 is made from a magnetizable material, as an alternative, the rotor 40 may be formed solely by the profile 42.

In the embodiment shown in FIG. 7A, a respective carriage 100 is inserted in or introduced into the right and left sides. The carriages 100 in turn are recognizable by the bushings 14 respectively projecting to the bottom. In the example shown, the carriages 100 thus have a body 101 similar to FIG. 2C. In FIG. 7B, showing the rotor 40 from the top in a plane view, it can be seen that the carriages 100 have respectively two rollers 102 preferably at each side, which, seen in ±y-coordinate direction, are disposed offset to each other at the sides.

At locations, at which the rotational axis receptions 106 of a respective carriage 100 are disposed, the profile 42 has through-openings 43. Seen in ±z-coordinate direction, the through-openings 43 are configured aligned with the rotational axis receptions 106. The respective rotational axis 105 projects with one or with both ends, to which a roller 102 is mounted, from the respective carriage and the profile 42 to the outside, i.e. in +z-, respectively −z-coordinate direction.

In case of one roller 102, respectively mounted to only one end of a rotational axis 105, there are two variants. In a first variant shown in FIG. 7A, the rotational axes 105, without a roller 102 mounted to their end, are likewise received in a through-opening 43 configured in the profile 42. This means, the respective rotational axis 105 is received and supported in the profile 42. If the rotational axes 105 are spindle inserts, preferably they serve additionally for mounting the respective carriage 100 in the profile 42. This means, the carriages 100 are positioned with regard to each other only by inserting the rotational axes 105 from one side of the profile 42 through a respective first through-opening 43, a rotational axis reception 106 in the body 101 of the respective carriage and, if necessary, a respective second through-opening 43 in the profile 42. Thus no additional arresting device is required.

Preferably, all through-openings 43 are configured complementary to a receiving, respectively to a supporting section of a respective rotational axis 105, i.e. preferably with a circular cross-section.

As explained above, one task of the profile 42 is to position the carriages 100, 100' with regard to each other. However, it is only necessary to stationarily mount one of the carriages 100, 100' to the profile. Therefore, it is intended, according to a further development of the invention, that only at least one through-opening 43, respectively one pair of through-openings 43 configured at opposite sidewalls of the profile 42, is complementarily configured to the respective rotational axis 105. At least one of the other through-openings 43, as shown by way of example in FIG. 8C, is configured in the shape of an oblong hole. Except for the carriage 100, 100' stationarily mounted to the profile 42, it is thereby possible for carriages 100, 100', to be supported displaceably in ±x-coordinate direction. This means, the profile 42 positions the carriages 100, 100', with regard to a height position, with regard to each other in the profile 42. It is thereby possible to utilize one and the same profile 42 for sliding door leaves 30, in which the suspensions respectively have different distances to each other. In addition thermal stress can be thus avoided, which might be generated on account of different thermal expansion behaviour of the carriages 100, 100' and of the profile 42. The flexibility of the profiles 42 with regard to their application is thus improved.

As illustrated at a larger scale on the bottom right side in FIG. 7A, the profile 42 is configured as being open to the bottom and, at lower ends of sidewalls, has projections 44 facing each other. It is by these projections 44, that a carriage 100, without rollers 102, can be introduced into the profile in ±x-coordinate direction, and the carriage 100 is held by the profile 42.

If the rotor 41 has a row of magnets 41, it is preferably intended, as shown in FIG. 7B, that the magnets 41*a* are disposed in such a way that a pole arrangement between directly adjacent disposed magnets 41*a* is alternating, consequently results in a pole arrangement with the sequence N-S-N- . . . , or S-N-S- . . . .

A sectional view of the arrangement along a line E-E in FIG. 7A is illustrated in FIG. 7C. In this illustration, the positions of the carriages 100 disposed at the left and rights sides are particularly well visible.

In addition, a carriage 100' is disposed in the centre of the profile 42. The carriage 100' differs from the carriage 100 mainly in that it has neither a recess 110 nor a hollow space 111 for the reception of a carriage suspension member 10. It simply serves support purposes for the profile 42 in non-illustrated guiding rails 1, 2, in order to counter the risk of unwanted bending or warping of the profile 42.

This precaution measure is in particular required if the profile 42 is a component of a rotor 40 of a linear motor. In this case, a distance to a stator is substantially guaranteed within a relatively small tolerance range.

As can be in particular seen in FIG. 7A, the rollers 102 of a respective carriage 100 are disposed such that, seen parallel to the plane of action x-z in ±z-coordinate direction, the exterior two rollers 102 are disposed slightly higher than the two interior rollers 102. This means, the exterior rollers 102 roll on two upper guiding rails 1, which are disposed at both sides of the rotor 40 and are non-illustrated. The interior rollers 102 roll on two lower guiding rails 2, which are likewise disposed at both sides of the rotor 40 and are non-illustrated. Thus, the carriages 100 are held in position in guiding rails, 1, 2 on account of the respective four rollers 102. This means, when mounting a sliding door leaf 30 for example to the carriages 100, no inadvertent tilting of the respective carriage in the guiding rails 1, 2 will occur, which makes mounting easier.

Thus the profile 42 guarantees a precise positioning of the carriages 100, 100' with regard to the profile 42, whereas the carriages 100, 100' guarantee the precise positioning of the rotor 40 with regard to a non-illustrated stator.

The disposition of the rotor 40 with regard to guiding rails 1, 2 will be explained in more detail in the following, reference being made to FIG. 7E.

Figure 7D:
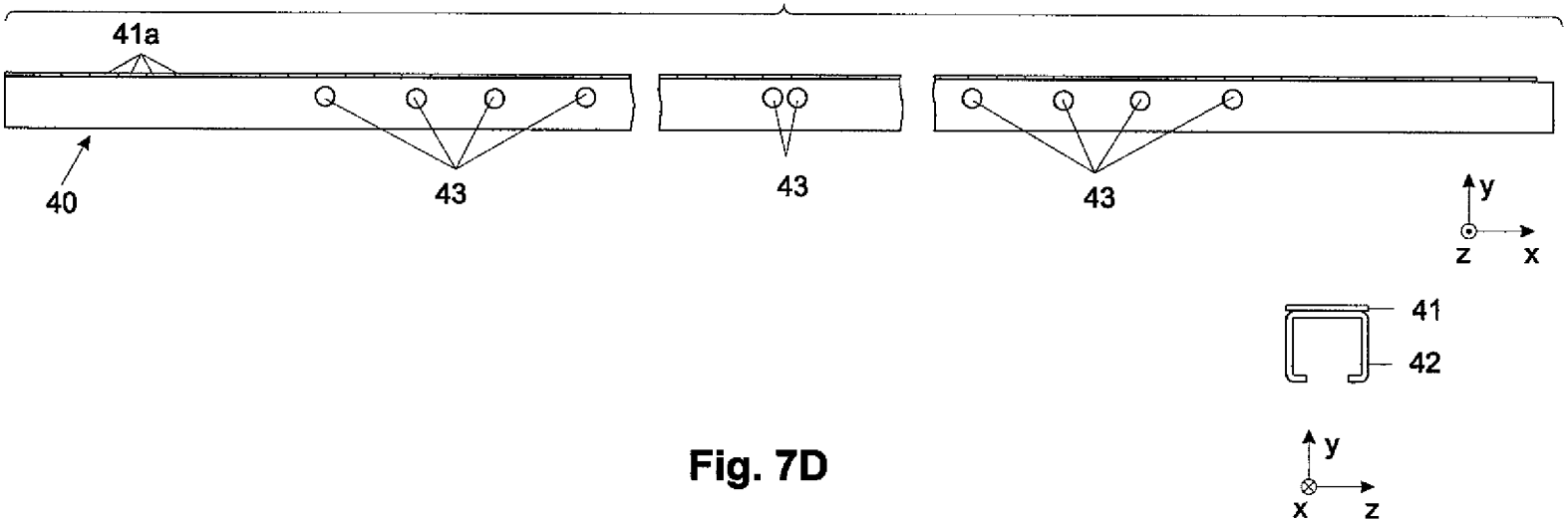

FIG. 7D shows the profile 42 without carriages 100, 100' being mounted.

Even if FIGS. 7A to 7D show a row of magnets 41, which extends over an entire length of the profile 42, the row may be provided only in portions or may extend only over a partial length of the profile 42. As the stability of the profile 42 is especially good in particular in areas of the carriages 100, 100', the row of magnets 41 may be configured such that the magnets 41*a* are only present in these areas.

Figure 7E:
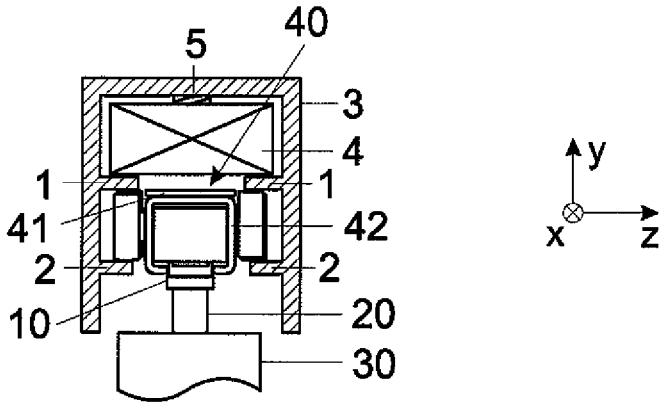

FIG. 7E shows a view of a suspension with a linear motor in a completed condition. All parts of the linear motor are received in a carrying profile 3. Preferably, the carrying profile has two reception spaces. An upper reception space serves to receive a stator 4 of the linear motor. At an underside, the stator 4 rests on two projections, which are preferably formed by upper sides of upper guiding rails 1. In order to position the stator 4 stationarily, it is mounted to the carrying profile or arrested thereat. This mounting or arresting may be realized by one or several screws 5 for example. In case of a mounting, the screw 5 is preferably screwed into an upper wall section of the carrying profile 3. In case of an arresting, the screw 5 is propped up at an underside of the upper wall section of the carrying profile and presses the stator 4 against the upper sides of the projections, on which the stator 4 rests. The stator 4 is thereby stationarily braced and arrested in the carrying profile 3.

The rotor 40 is disposed between upper guiding rails 1 and lower guiding rails 2. Below, as already described, a sliding door leaf 30 is suspended by sliding door suspension members 20 at carriage suspension members 10 of carriages 100.

According to an advantageous further development of the invention, it is intended that the carriages 100, 100' are not received in a single profile 42. The suspension system has at least two profiles 42.

Figure 8A:
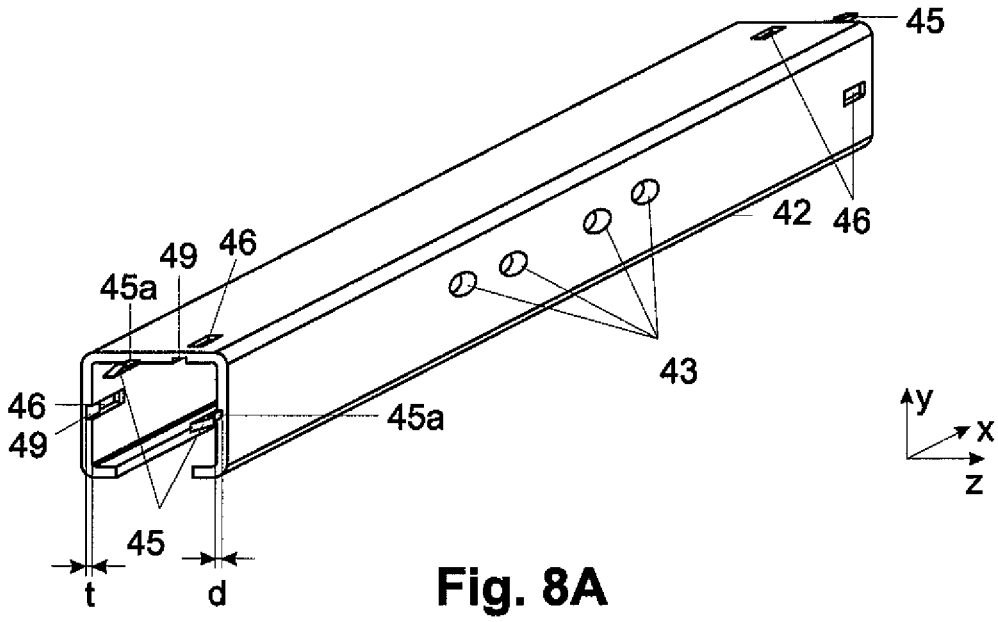
FIG. 8: are profiles according to different embodiments of the invention.

FIG. 8A shows a profile 42, which, by way of example, is adapted to receive a carriage 100. In addition to the through-openings 43 for receiving rotational axes 105 of a carriage 100, the profile 42, at least at one front side in the direction of a longitudinal extension of the profile 42, has latching projections in the shape of latching noses or projections 45, pointing away from the profile 42. Latching noses 45, or as shown in FIG. 8A, latching receptions 46 for receiving latching noses of another profile 42 may be likewise configured at the respective other front side. The latching receptions 46 are preferably configured as depressions, respectively as recesses, or according to FIG. 8A as through-openings. In addition, grooves 49 are respectively configured at an interior wall of the profile 42 and extend from a frontal face of the profile 42 towards the respective latching reception 46. Preferably the grooves 49 have a depth t, which essentially corresponds to a thickness d of an extension section 45*a* of a corresponding latching nose 45 of another profile 42. The grooves facilitate sliding one profile 42 onto another one. Preferably, all extension sections 45*a* and grooves 49 have one and the same thickness d, respectively depth t.

The latching noses 45 and latching receptions 46 are preferably rotation-symmetrically disposed at the front sides. This means, the latching noses 45 and the latching receptions 46 are disposed such that both front sides, seen from the front, respectively have the same appearance. Therefore, it does not make any difference with which front side the profile 42 is clipped or latched to another non-illustrated profile 42, which makes mounting easier.

Figure 8B:
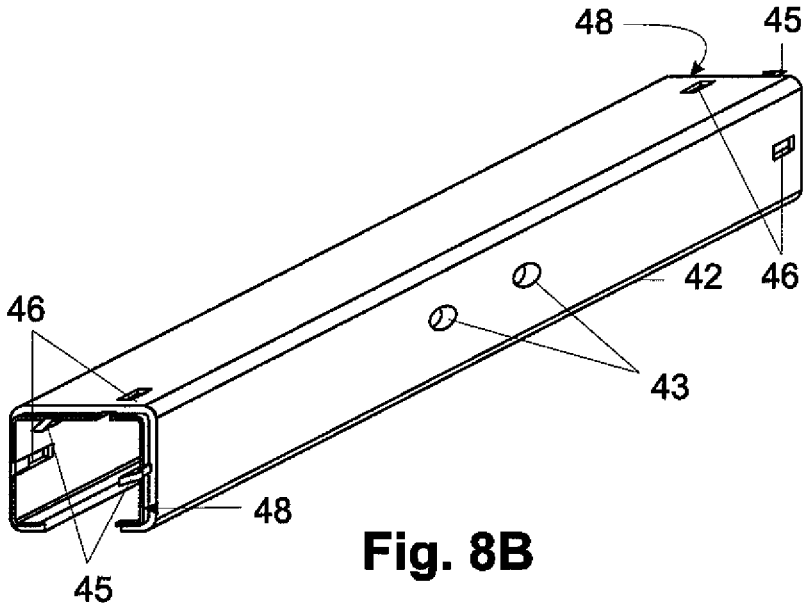
Figure 8C:
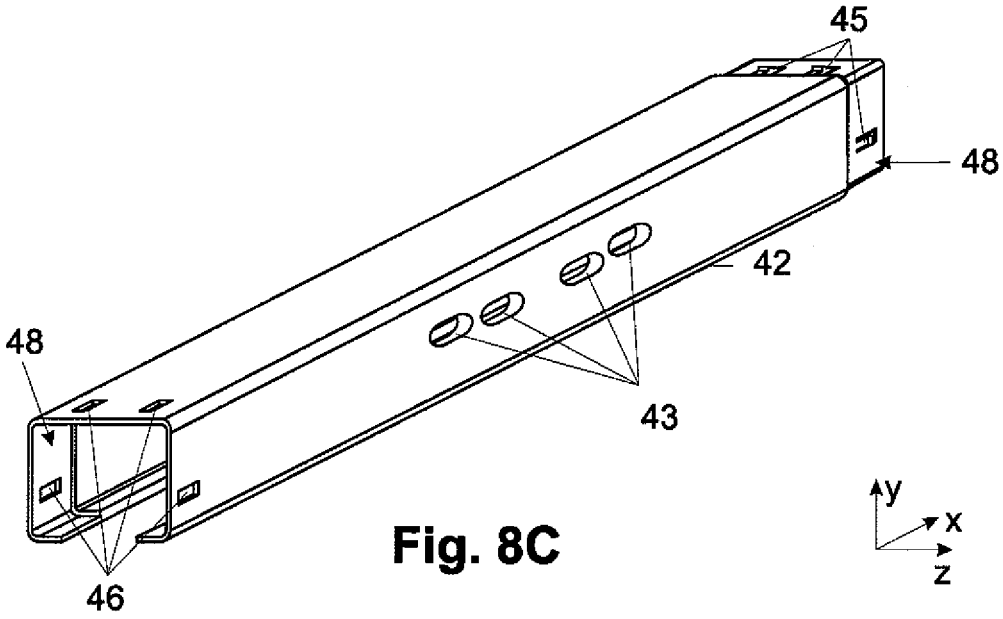

To prevent the latching noses 45 from canting or breaking off, according to an embodiment of the invention shown in FIG. 8B, one placing section 48 is provided at each front side. The profile 42, shown in FIG. 8B by way of example, is configured for receiving a carriage 100'. At a frontal front side in FIG. 8B, the profile has a placing section 48 in the shape of a projecting interior walling, which, compared to a wall thickness of the profile 42, has a thinner wall. At the rear front side, the profile 42 has likewise a placing section 48, this time in the shape of a projecting exterior walling, which, when compared to a wall thickness of the profile 42, has a thinner wall. An interior contour of the exterior walling is configured essentially complementary to an exterior contour of the interior walling, such that two profiles 42 can be fitted together with front sides, which are complementarily configured with regard to each other. During the fitting procedure, the exterior walling of one profile 42 slides over the interior walling of the other profile 42, and the latching noses 45 of the one profile 42 latch with the corresponding latching receptions 46 of the other profile 42.

As an alternative, there are two types of profiles 42, one with exclusively projecting interior wallings at the front side, and another one with exclusively projecting exterior wallings at the front sides. For visual reasons there could be a third and fourth type of profiles 42, in which, at one of the front sides, no placing section and no latching noses nor latching receptions are provided. When considering the entire profile, these profiles 42 represent lateral terminal profiles.

In a profile 42 shown in FIG. 8C, according to another embodiment of the invention, it is intended that the latching noses 45 and/or latching receptions 46 are configured in the placing sections 48. This means, the placing sections 48 project further than in the embodiment of the invention shown in FIG. 8B. The latching noses 45 are thus surrounded by the respective placing section 48, which provides even more protection against accidental breaking off of the latching noses 45. In addition, the through-openings 43 are configured as oblong holes by way of example, which allows for the above described application flexibility and compensation ability, for example with regard to thermal stress.

Figure 8D:
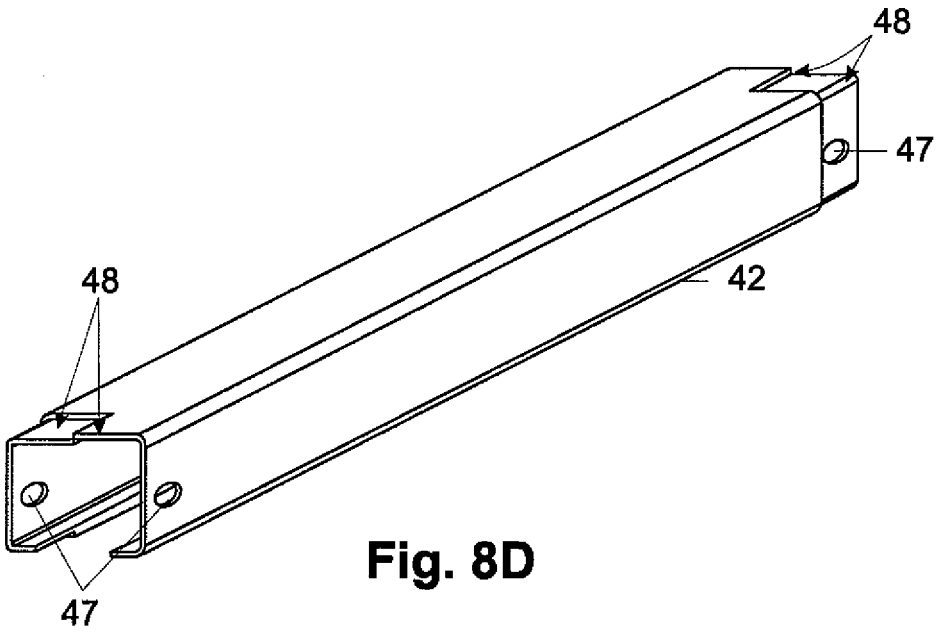

In FIG. 8D, a profile 42 is shown according to yet another embodiment of the invention. By way of example, the profile 42 is not designed for a reception of carriages 100, 100', but serves as a connecting member between two other profiles 42. In the direction of the longitudinal extension of the profile 42 at each front side, seen in horizontal direction at one half of a front side, one projecting interior walling section and, at another half, one exterior walling section are configured as the placing section 48. This means, the front sides are configured rotation-symmetrically as shown in the embodiment in FIG. 8A, which results in the above described advantages. According to FIG. 8D, instead of latching noses and latching receptions 46, attachment openings 47 are provided preferably in opposite sidewalls in areas of the placing sections 48. Once the two profiles 42 have been assembled, in the simplest case, they are screwed to each other.

The profiles 42, shown in FIG. 8A to 8D, offer the advantage of allowing to manufacture standardized profile parts 42. One type of profile parts 42 is provided with through-openings 43 for the reception of a carriage 100 and/or a carriage 100'. Another type of profile parts 42 does not have any through-openings 43. This other type of profiles 42 is configured preferably as being insertable between profile parts 42 receiving carriages 100, 100', and as being able to be cut to length, preferably after manufacturing. The application flexibility of such profiles 42 is thereby increased and the manufacturing costs are lowered.

The embodiments shown in FIGS. 8A to 8D are exchangeable or can be combined with each other. The attachment openings 47 may be configured instead or in addition to the latching noses 45 and latching receptions 46. The number and the disposition of the latching noses 45, latching receptions 46 or attachment openings 47 may vary. For example in the embodiment shown in FIG. 8C, it is possible to configure the latching receptions 46 and the latching noses 45 rotation-symmetrically. As an alternative, respectively exclusively latching receptions 46 or latching noses 45 may be provided, which results in requiring two types of profiles 42.

If a magnetic force of attraction of the here described row of magnets 41 with regard to the stator 4 is larger than a weight force of the suspended panel to be moved 30 including the profile 42, the carriages 100, 100' and the suspension members 20, the lower guiding rails 2 and the rollers 102 rolling thereon can be foregone. The rollers 102, rolling on the upper guiding rails 1, are still provided in order to guarantee a distance within certain limits between the row of magnets 41 and the stator 4.

Instead of a linear motor as the drive system, likewise a spindle drive may be provided. For this purpose, at least one driver bushing is attached at the profile 42 or at one or more carriages 100, 100'. The one or more bushings is, respectively are disposed in the upper reception space of the carrying profile 3 and extend in ±x-coordinate direction in the Figures. Each bushing is screwed onto a threaded spindle, which is likewise disposed in the upper reception space of the carrying profile 3 such as to extend in the same direction and is operatively connected to an output shaft of a drive motor.

As an alternative, likewise a flexible drive may be provided. For this purpose, at least one driver is attached at the profile 42 or at one or several carriages 100, 100'. The one or more drivers projects, respectively project from the profile 42 or from the respective carriage 100, 100' and protrude into the upper reception space of the carrying profile 3. Each driver is attached at a traction device the flexible drive. The traction device is likewise disposed in the upper reception space of the carrying profile 3, such as to extend in ±x-coordinate direction, and is preferably guided around two deflection pulleys. Preferably one of the deflection pulleys is operatively connected to an output shaft of a drive motor. A traction rope, a traction or toothed belt for example are suitable as traction devices.

The described embodiments are likewise applicable to manually operated sliding door installations, in this case just the row of magnets 41 and possibly the profile 42 are foregone.

Even if the invention has been described based on a suspended sliding door leaf, which is guided along a straight travel path, it is applicable to other suspension systems as well.

In case of a (partially) circular-shaped travel path, such as it is usual in curved sliding doors for example, the carriages 100, 100' may be configured such that respectively two rotational axes 105 are configured to be not precisely axially parallel with regard to each other, but have an angle with regard to each other corresponding to the curvature of the travel path. In this case, the angle corresponds to an angle included in two lines of a circle radius, which extend from axial centres of the respective two rotational axes 105 to a centre of a circle, which is defined by the travel path. In case of a linear drive, profile 42, row of magnets 41 and stator 4 are preferably formed, respectively configured according to the curvature of the travel path.

In case of folding leaf doors for example, it may be intended to mount the carriage 100 torque-proof or freely rotatably at pivot points between two directly adjacent folding leaves. This means, the carriages 100 do not move the folding door leaf itself, but the pivot joints thereof, by which the individual folding leaves are articulately connected to each other. In case of hinges between the folding leaves, it may be intended to provide a driver, for example in the shape of a pin between the carriages and the hinge. A torque-proof disposition with a respective pivot point is possible, if the pivot joint is freely rotatably disposed with regard to the directly articulated folding leaves.

In case of partitioning walls or sliding doors, which are to be moved along a curved travel path, carriages 100 are likewise provided, which are articulately supported with regard to a respective partitioning wall module or to a respective sliding door leaf.

Altogether, the described carriages, as well as the suspensions are very flexible in terms of their application.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A carriage, comprising:

a body;

at least one first roller freely rotatably mounted in the body;

a first suspension member comprising:

an upper terminal section pivotable about at least one axis of rotation extending parallel to a longitudinal extension of the carriage supported at the body; and a lower terminal section configured to extend in a vertically downward direction towards a panel to be moved along a travel path, the lower terminal section configured to suspend the panel to be moved, wherein an axis of rotation of the at least one first roller extends transversely to the downward direction and transversely to a tangent of the travel path of the at least one panel to be moved in an area of the at least one roller;

at least one second roller having an axis of rotation extending transversely to the vertically downward direction and transversely to the tangent of the travel path of the at least one panel to be moved in an area of the at least one second roller, at least one second roller seen in the direction of the longitudinal extension of the carriage is arranged a predetermined vertical distance to the axis of rotation of the at least one first roller;

at least one third roller having an axis of rotation extending transversely to the vertically downward direction and transversely to the tangent of the travel path of the at least one panel to be moved in an area of the at least one third roller, the at least one third roller is configured to be aligned with the at least one first roller;

at least one arm projecting in the direction of the longitudinal extension of the carriage from at least one of a front and a rear of the body, the at least one arm configured in downward direction to have a depth that is less than a central section of the body directly adjoining the arm, wherein, at a free end of each of the at least one arm, at least one of the rollers is freely rotatably mounted and the first suspension member is supported at or in the central section of the body, wherein the upper terminal section of the first suspension member is received and freely rotatably supported in a hollow space of the body, wherein the hollow space is configured complementary to an exterior contour of a corresponding area of the upper terminal section of the first suspension member, wherein the first suspension member is resiliently supported by a resilient support at an end formed by the upper terminal section and faces away from the panel to be moved.

2. The carriage according to claim 1, wherein the at least one first and the at least one third roller, seen in the direction of a longitudinal extension of one of the axes of rotation of the rollers, are arranged at a frontal side of the carriage, and the at least one second roller is disposed at a rear side of the carriage, opposite the frontal side and facing away from the frontal side of the carriage.

3. The carriage according to claim 2, wherein, in an inserted condition of the carriage wherein the carriage is inserted, in guiding rails the predetermined vertical distance is smaller than in a not inserted condition of the carriage.

4. The carriage according to claim 1, wherein the upper terminal section of the first suspension member is configured as an ellipsoid, in which a longitudinal extension of the upper terminal section extends parallel to the longitudinal extension of the carriage.

5. The carriage according to claim 1, wherein the upper terminal section of the first suspension member is configured to be cylindrical-shaped having one of a flat or a convex-shaped frontal face, wherein a longitudinal extension of the upper terminal section extends in the direction of the longitudinal extension of the carriage.

6. The carriage according to claim 1, wherein the first suspension member, with the upper terminal section, is pivotally supported about an arbitrary axis.

7. The carriage according to claim 6, wherein the upper terminal section of the first suspension member is configured in the shape of a sphere.

8. The carriage according to claim 7, wherein the sphere is configured flattened, at least at one end, which is formed by the upper terminal section of the first suspension member and which faces away from the panel to be moved.

9. The carriage according to claim 1, wherein the resilient support of the first suspension member further comprises a spring supported at an end of an interior wall of the hollow space of the body and faces away from the first suspension member.

10. The carriage according to claim 1, wherein the resilient support of the first suspension member further comprises a spring, wherein the spring is supported at an end, which faces away from the first suspension member, by a support device.

11. The carriage according to one of the claims 1, wherein the body has a through-opening, which is configured to extend from a seating surface of the upper terminal section on, respectively in the recess or the hollow space of the body in a vertically downward direction.

12. The carriage according to claim 1, wherein the first suspension member is configured to mount a second suspension member configured to be one of:

mounted stationarily to the at least one panel to be moved and integrally configured as a frame element of the at least one panel to be moved.

13. The carriage according to claim 12, wherein, at the lower terminal section, the first suspension member comprises a bushing that is freely rotatably disposed on the lower terminal section with a section of predetermined length that projects from the lower terminal section in the downward direction, the section of predetermined length having a female thread section, wherein the second suspension member, at an upper terminal section facing the first suspension member, comprises a male thread section configured complementary to the female thread section, wherein the bushing, at least in a partial section, has a non-circular exterior contour.

14. The carriage according to claim 13, wherein the non-circular exterior contour is configured as an external hexagon section.

15. The carriage according to claim 13, wherein the bushing is integrally configured with the lower terminal section of the first suspension member.

16. The carriage according to claim 13, wherein the bushing is disposed at the second suspension member such that its section of predetermined length projects from the second suspension member towards the first suspension member, wherein the male thread section is configured at the lower terminal section of the first suspension member.

17. The carriage according to claim 1, wherein the body is block-shaped.

18. The carriage according to claim 17, wherein the body is made from plastic material.

19. The carriage according to claim 1, wherein each roller has a respective rotational axis, wherein a respective reception configured as a bore or a through-opening is arranged in the body for each respective rotational axis.

20. The carriage according to claim 19, wherein, a respective reception in an inner space comprises a projection in a plane transverse to a longitudinal extension of the respective rotational axis configured to project from an inner surface of the reception in the direction of an inner space of the reception, wherein a respective rotational axis of the respective roller has a recess at a circumference, which is configured essentially complementary to the projection, such that, when inserting the rotational axis into the respective reception, the projection of the rotational axis reaches engagement with the respective reception preventing movement in a direction parallel to the rotational axis longitudinal extension.

21. The carriage according to claim 1, wherein the at least one panel to be moved is one of a sliding door leaf, a curved sliding door leaf, a partitioning wall module, and a folding door leaf.

22. A suspension system, comprising:

at least one first guiding rail;

at least one panel to be moved is one of stationarily disposed at a second suspension member of at least two carriages, and integrally configured with the second suspension members of the carriages, each carriage, comprising:

a body;

at least one first roller freely rotatably mounted in the body;

a first suspension member comprising:

an upper terminal section pivotable about at least one axis of rotation extending parallel to a longitudinal extension of the carriage supported at the body; and a lower terminal section configured to extend in a vertically downward direction towards a panel to be moved along a travel path, the lower terminal section configured to suspend the panel to be moved using an associated one of the second suspension members, wherein an axis of rotation of the at least one first roller extends transversely to the downward direction and transversely to a tangent of the travel path of the at least one panel to be moved in an area of the at least one roller;

at least one second roller having an axis of rotation extending transversely to the vertically downward direction and transversely to the tangent of the travel path of the at least one panel to be moved in an area of the at least one second roller, at least one second roller seen in the direction of the longitudinal extension of the carriage is arranged a predetermined vertical distance to the axis of rotation of the at least one first roller;

at least one third roller having an axis of rotation extending transversely to the vertically downward direction and transversely to the tangent of the travel path of the at least one panel to be moved in an area of the at least one third roller, the at least one third roller is configured to be aligned with the at least one first roller;

at least one arm projecting in the direction of the longitudinal extension of the carriage from at least one of a front and a rear of the body, the at least one arm configured in downward direction to have a smaller depth than a central section of the body directly adjoining the arm, wherein, at a free end of at least one arm, at least one of the rollers is freely rotatably mounted and the first suspension member is supported at or in the central section of the body wherein the at least one roller is disposed to roll on the at least one first guiding rail; and a profile open at a side facing the at least one panel to be moved and extends essentially along at least one portion of the travel path of the at least one panel to be moved in which the carriages are received, wherein at least one carriage is stationarily received in the profile, wherein the profile comprises through-openings configured for inserting rotational axes of the rollers of the carriages that extend in a direction parallel to a longitudinal extension of the rotational axes.

23. The suspension system according to claim 22, further comprising at least one second guiding rail wherein one of the at least two rollers of the respective carriage is disposed to roll on the at least one first guiding rail and the respective other roller of the respective carriage on the at least one second guiding rail, wherein the running surfaces of the at least one first and second guiding rails face each other.

24. The suspension system according to claim 23, wherein the first and second guiding rails are one of in disposed a carrying profile and integrally configured with the carrying profile.

25. The suspension system according to claim 22, further comprising at least one additional carriage that comprises a body in which at least one roller is freely rotatably mounted, wherein an axis of rotation of the at least one additional roller extends transversely to a vertically downward direction and transversely to a tangent of the travel path of the at least one panel to be moved in an area of the at least one roller, wherein at least one carriage is stationarily received in the profile.

26. The suspension system according to claim 22, wherein the profile has two through-openings for inserting at least one rotational axis of a roller of a carriage, the through-openings arranged at opposite sidewall sections of the profile.

27. The suspension system according to claims 26, wherein the profile has a C-shaped cross-section.

28. The suspension system according to claim 27, wherein the profile, at free ends in cross-section has respective projections, configured to extend towards each other.

29. The suspension system according to claim 22, wherein the profile comprises several parts, which are adapted to be stationarily mounted as a linear unit.

30. The suspension system according to claim 29, wherein the parts of the profile at sides facing each other, respectively have one part of a clipping or latching connection.

31. The suspension system according to claim 22, furthermore having a linear drive for moving the at least one panel to be moved.

32. The suspension system according to claim 31, wherein the linear drive comprises at least one linear motor, the at least one linear motor comprising:

a stator formed by a row of coils, which is stationarily disposed at a predetermined distance to one of a side of at least one body and the profile, a side facing away from the at least one panel to be moved, and extends along at least one portion of a travel path of the at least one panel to be moved; and a rotor configured to interact with the stator to form the linear drive.

33. The suspension system according to claim 32, wherein the profile comprises a magnetizable material.

34. The suspension system according to claim 33, wherein the rotor of the linear motor is formed by the profile.

35. The suspension system according to claim 32, wherein the rotor is formed by at least one row of magnets disposed in one row extending along at least one section of the profile and is stationarily mounted at one side of the profile facing away from the at least one panel to be moved.

36. The suspension system according to claim 31, wherein the linear drive is formed by one of a spindle drive and a flexible drive.

* * * * *